US008506378B2

(12) United States Patent
Thoeni et al.

(10) Patent No.: US 8,506,378 B2
(45) Date of Patent: Aug. 13, 2013

(54) GAMING SYSTEM, GAMING DEVICE, AND METHOD PROVIDING ADVERTISING MESSAGES TO PLAYERS BASED ON A DETERMINATION OF A POSITIVE WINNING GAMING SESSION

(75) Inventors: Stewart Thoeni, Reno, NV (US); Chauncey Griswold, Reno, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 13/238,713

(22) Filed: Sep. 21, 2011

(65) Prior Publication Data

US 2013/0072288 A1 Mar. 21, 2013

(51) Int. Cl.
*G07F 17/32* (2006.01)

(52) U.S. Cl.
USPC ..... 463/16; 463/20; 463/25

(58) Field of Classification Search
USPC ..... 463/16–20, 25–29, 31, 33, 42
See application file for complete search history.

(56) References Cited

U.S. PATENT DOCUMENTS

| | | | |
|---|---|---|---|
| 3,129,004 | A | 4/1964 | Ritzler |
| 3,468,476 | A | 9/1969 | Keegan |
| 3,852,576 | A | 12/1974 | Rudd |
| 4,301,505 | A | 11/1981 | Catiller et al. |
| 4,592,546 | A | 6/1986 | Fascenda et al. |
| 4,607,155 | A | 8/1986 | Nao et al. |
| 4,652,998 | A | 3/1987 | Koza et al. |
| 4,667,336 | A | 5/1987 | Best |
| 4,745,468 | A | 5/1988 | Von Kohorn |
| 4,815,741 | A | 3/1989 | Small |
| 4,854,590 | A | 8/1989 | Jolliff et al. |
| 4,869,500 | A | 9/1989 | Williams |
| 4,876,592 | A | 10/1989 | Von Kohorn |
| 4,890,842 | A | 1/1990 | Plange |
| 4,982,346 | A | 1/1991 | Girouard et al. |
| 5,022,172 | A | 6/1991 | Kawahara et al. |
| 5,025,372 | A | 6/1991 | Burton et al. |
| 5,057,915 | A | 10/1991 | Von Kohorn |
| 5,076,613 | A | 12/1991 | Kovacs |
| 5,080,364 | A | 1/1992 | Seidman |

(Continued)

FOREIGN PATENT DOCUMENTS

| | | |
|---|---|---|
| EP | 1 746 550 | 1/2007 |
| EP | 1 814 091 | 8/2007 |

(Continued)

OTHER PUBLICATIONS

International Search Report and Written Opinion of the International Searching Authority for corresponding PCT Application No. PCT/US2012/53787, mailed Nov. 29, 2012 (10 pages).

*Primary Examiner* — Omkar Deodhar
(74) *Attorney, Agent, or Firm* — Neal, Gerber & Eisenberg LLP

(57) ABSTRACT

A gaming system, gaming device, and method providing advertising messages to players based on a determination of a positive winning gaming session. In one embodiment, the gaming system monitors a plurality of plays of at least one wagering game during a designated period. At the end of the designated period, the gaming system determines whether a player of the monitored plays had a positive winning gaming session. If the player had a positive winning gaming session, the gaming system provides at least one advertising message to the player.

41 Claims, 13 Drawing Sheets

(56) References Cited

U.S. PATENT DOCUMENTS 5,083,271 A 1/1992 Thacher et al.
5,099,232 A 3/1992 Howes
5,129,652 A 7/1992 Wilkinson
5,137,278 A 8/1992 Schilling et al.
5,229,764 A 7/1993 Matchett et al.
5,231,568 A 7/1993 Cohen et al.
5,259,613 A 11/1993 Marnell, II
5,269,522 A 12/1993 Chagoll et al.
5,283,734 A 2/1994 Von Kohorn
5,290,033 A 3/1994 Bittner et al.
5,361,871 A 11/1994 Gupta et al.
5,362,051 A 11/1994 Swafford, Jr. et al.
5,367,644 A 11/1994 Yokoyama et al.
5,368,129 A 11/1994 Von Kohorn
5,373,440 A 12/1994 Cohen et al.
5,379,382 A 1/1995 Work et al.
5,392,066 A 2/1995 Fisher et al.
5,397,125 A 3/1995 Adams
5,429,361 A 7/1995 Raven et al.
5,470,079 A 11/1995 LeStrange et al.
5,488,411 A 1/1996 Lewis
5,551,692 A 9/1996 Pettit et al.
5,555,497 A 9/1996 Helbling
5,555,991 A 9/1996 Hart
5,559,794 A 9/1996 Willis et al.
5,564,546 A 10/1996 Molbak et al.
5,586,936 A 12/1996 Bennett
5,609,337 A 3/1997 Clapper, Jr.
5,615,109 A 3/1997 Eder
5,620,182 A 4/1997 Rossides
5,635,696 A 6/1997 Dabrowski et al.
5,636,346 A 6/1997 Saxe
5,643,086 A 7/1997 Alcorn et al.
5,643,088 A 7/1997 Vaughn et al.
5,668,591 A 9/1997 Shintani
5,674,128 A 10/1997 Holch et al.
5,695,402 A 12/1997 Stupak
5,697,844 A 12/1997 Von Kohorn
5,708,838 A 1/1998 Robinson
5,721,827 A 2/1998 Logan et al.
5,721,958 A 2/1998 Kikinis
5,722,890 A 3/1998 Libby et al.
5,729,697 A 3/1998 Schkolnick et al.
5,741,183 A 4/1998 Acres et al.
5,759,101 A 6/1998 Von Kohorn
5,759,102 A 6/1998 Pease et al.
5,761,647 A 6/1998 Boushy
5,779,549 A 7/1998 Walker et al.
5,791,991 A 8/1998 Small
5,806,852 A 9/1998 Howes
5,813,913 A 9/1998 Berner et al.
5,816,918 A 10/1998 Kelly et al.
5,820,459 A 10/1998 Acres et al.
5,823,874 A 10/1998 Adams
5,833,540 A 11/1998 Miodunski et al.
5,848,399 A 12/1998 Burke
5,848,935 A 12/1998 Noell et al.
5,851,147 A 12/1998 Stupak et al.
5,851,149 A 12/1998 Xidos et al.
5,855,514 A 1/1999 Kamille
5,857,175 A 1/1999 Day et al.
5,859,414 A 1/1999 Grimes et al.
5,882,258 A 3/1999 Kelly et al.
5,883,620 A 3/1999 Hobbs et al.
5,912,743 A 6/1999 Kinebuchi et al.
5,918,211 A 6/1999 Sloane
5,919,091 A 7/1999 Bell et al.
5,928,082 A 7/1999 Clapper, Jr.
5,933,811 A 8/1999 Angles et al.
5,933,813 A 8/1999 Teicher et al.
5,935,000 A 8/1999 Sanchez, III et al.
5,939,695 A 8/1999 Nelson
5,941,771 A 8/1999 Haste, III
5,941,772 A 8/1999 Paige
5,943,241 A 8/1999 Nichols et al.
5,946,646 A 8/1999 Schena et al.
5,946,664 A 8/1999 Ebisawa
5,949,042 A 9/1999 Dietz, II et al.
5,950,173 A 9/1999 Perkowski
5,951,397 A 9/1999 Dickinson
5,958,020 A 9/1999 Evoy et al.
5,962,831 A 10/1999 Byrley
5,978,920 A 11/1999 Lee
5,979,757 A 11/1999 Tracy et al.
5,980,385 A 11/1999 Clapper, Jr.
5,991,736 A 11/1999 Ferguson et al.
5,993,316 A 11/1999 Coyle et al.
6,003,013 A 12/1999 Boushy et al.
6,006,257 A 12/1999 Slezak
6,007,426 A 12/1999 Kelly et al.
6,009,410 A 12/1999 LeMole et al.
6,009,412 A 12/1999 Storey
6,012,984 A 1/2000 Roseman
6,015,344 A 1/2000 Kelly et al.
6,017,032 A 1/2000 Grippo et al.
6,021,362 A 2/2000 Maggard et al.
6,024,642 A 2/2000 Stupak
6,026,370 A 2/2000 Jermyn
6,035,279 A 3/2000 Montangero et al.
6,036,601 A 3/2000 Heckel
6,039,648 A 3/2000 Guinn et al.
6,041,308 A 3/2000 Walker et al.
6,048,268 A 4/2000 Humble
6,048,269 A 4/2000 Burns et al.
6,071,190 A 6/2000 Weiss et al.
6,088,802 A 7/2000 Bialick et al.
6,089,975 A 7/2000 Dunn
6,089,981 A 7/2000 Brenner et al.
6,098,837 A 8/2000 Izawa et al.
6,102,799 A 8/2000 Stupak
6,104,815 A 8/2000 Alcorn et al.
6,106,396 A 8/2000 Alcorn et al.
6,110,042 A 8/2000 Walker et al.
6,113,495 A 9/2000 Walker et al.
6,117,010 A 9/2000 Canterbury et al.
6,119,101 A 9/2000 Peckover
6,135,887 A 10/2000 Pease et al.
6,138,911 A 10/2000 Fredregill et al.
6,141,006 A 10/2000 Knowlton et al.
6,142,876 A 11/2000 Cumbers
6,149,522 A 11/2000 Alcorn et al.
6,162,122 A 12/2000 Acres et al.
6,165,070 A 12/2000 Nolte et al.
6,168,522 B1 1/2001 Walker et al.
6,173,267 B1 1/2001 Cairns
6,183,362 B1 2/2001 Boushy
6,183,366 B1 2/2001 Goldberg
6,186,893 B1 2/2001 Walker et al.
6,193,608 B1 2/2001 Walker et al.
6,196,920 B1 3/2001 Spaur et al.
6,210,279 B1 4/2001 Dickinson
6,213,874 B1 4/2001 Heflin
6,234,897 B1 5/2001 Frohm et al.
6,244,958 B1 6/2001 Acres
6,251,017 B1 6/2001 Leason et al.
6,264,556 B1 7/2001 Izawa et al.
6,267,672 B1 7/2001 Vance
6,267,675 B1 7/2001 Lee
6,280,326 B1 8/2001 Saunders
6,280,328 B1 8/2001 Holch et al.
6,289,261 B1 9/2001 Hiedel et al.
6,293,867 B1 9/2001 Heidel et al.
6,302,793 B1 10/2001 Fertitta, III et al.
6,306,035 B1 10/2001 Kelly et al.
6,315,665 B1 11/2001 Faith
6,322,309 B1 11/2001 Thomas et al.
6,324,519 B1 11/2001 Eldering
6,332,099 B1 12/2001 Heidel et al.
6,352,175 B2 3/2002 Izawa et al.
6,368,216 B1 4/2002 Hedrick et al.
6,379,251 B1 4/2002 Auxier et al.
6,381,626 B1 4/2002 DeLeo et al.
6,390,917 B1 5/2002 Walker et al.
6,401,074 B1 6/2002 Sleeper 6,439,997 B1 8/2002 Brasseur et al.
6,443,843 B1 9/2002 Walker et al.
6,447,395 B1 9/2002 Stevens
6,454,649 B1 9/2002 Mattice et al.
6,484,146 B2 11/2002 Day et al.
6,484,148 B1 11/2002 Boyd
6,523,824 B1 2/2003 Colapinto et al.
6,540,609 B1 4/2003 Paige
6,565,434 B1 5/2003 Acres
6,567,786 B1 5/2003 Bibelnieks et al.
6,567,842 B2 5/2003 DeLeo et al.
6,571,216 B1 5/2003 Garg et al.
6,578,012 B1 6/2003 Storey
6,595,859 B2 7/2003 Lynn
6,606,745 B2 8/2003 Maggio
6,609,969 B1 8/2003 Luciano et al.
6,609,978 B1 8/2003 Paulsen
6,616,533 B1 9/2003 Rashkovskiy
6,623,357 B2 9/2003 Chowdhury
6,625,578 B2 9/2003 Spaur et al.
6,633,850 B1 10/2003 Gabbard et al.
6,634,550 B1 10/2003 Walker et al.
6,645,068 B1 11/2003 Kelly et al.
6,656,050 B2 12/2003 Busch et al.
6,663,105 B1 12/2003 Sullivan et al.
6,712,702 B2 3/2004 Goldberg et al.
6,729,884 B1 5/2004 Kelton et al.
6,749,504 B2 6/2004 Hughs-Baird
6,749,511 B2 6/2004 Day
6,764,395 B1 7/2004 Guyett
6,786,824 B2 9/2004 Cannon
6,790,142 B2 9/2004 Okada et al.
6,834,856 B2 12/2004 Wilson
6,857,959 B1 2/2005 Nguyen
6,882,978 B2 4/2005 Ebisawa
6,885,995 B2 4/2005 Bell et al.
6,890,256 B2 5/2005 Walker et al.
6,899,626 B1 5/2005 Luciano et al.
6,907,400 B1 6/2005 Matsko et al.
6,912,504 B1 6/2005 Rashkovskiy
6,928,414 B1 8/2005 Kim
6,937,995 B1 8/2005 Kepecs
6,966,836 B1 11/2005 Rush et al.
7,024,374 B1 4/2006 Day et al.
7,025,674 B2 4/2006 Adams et al.
7,038,637 B1 5/2006 Eller et al.
7,052,392 B2 5/2006 Tessmer et al.
7,054,830 B1 5/2006 Eggleston et al.
7,054,831 B2 5/2006 Koenig
7,056,208 B2 6/2006 Cogert
7,063,617 B2 6/2006 Brosnan et al.
7,076,445 B1 7/2006 Cartwright
7,085,733 B2 8/2006 Ebisawa
7,094,149 B2 8/2006 Walker et al.
7,096,190 B2 8/2006 Postrel
7,127,069 B2 10/2006 Nguyen
7,139,725 B1 11/2006 Moyerson
7,140,964 B2 11/2006 Walker et al.
7,168,617 B2 1/2007 Walker et al.
7,192,350 B2 3/2007 Nguyen
7,216,754 B2 5/2007 Tedesco et al.
7,275,990 B2 10/2007 Walker et al.
7,341,517 B2 3/2008 Asher et al.
7,347,775 B2 3/2008 Roemer
7,387,571 B2 6/2008 Walker et al.
7,390,264 B2 6/2008 Walker et al.
7,392,470 B2 6/2008 Kammler
7,401,032 B1 7/2008 Golden et al.
7,455,586 B2 11/2008 Nguyen et al.
7,485,040 B2 2/2009 Walker et al.
7,566,274 B2 7/2009 Johnson et al.
7,658,674 B2 2/2010 Walker et al.
7,862,429 B2 1/2011 Walker et al.
7,878,901 B2 2/2011 Walker et al.
7,972,213 B2 7/2011 Walker et al.
7,997,972 B2 8/2011 Nguyen et al.
2001/0041609 A1 11/2001 Oranges et al.
2002/0002075 A1 1/2002 Rowe
2002/0013744 A1 1/2002 Tsunenari et al.
2002/0039921 A1 4/2002 Rowe et al.
2002/0039923 A1 4/2002 Cannon et al.
2002/0077169 A1 6/2002 Kelly et al.
2002/0094871 A1 7/2002 Luciano et al.
2002/0107610 A1 8/2002 Kaehler et al.
2002/0111210 A1 8/2002 Luciano et al.
2002/0128057 A1 9/2002 Walker et al.
2002/0138342 A1 9/2002 Clark et al.
2002/0143619 A1 10/2002 Laurie
2002/0155877 A1 10/2002 Enzminger et al.
2002/0155891 A1 10/2002 Okada et al.
2002/0177479 A1 11/2002 Walker et al.
2003/0003983 A1 1/2003 Walker et al.
2003/0004871 A1 1/2003 Rowe
2003/0013527 A1 1/2003 Rowe et al.
2003/0013532 A1 1/2003 Rowe et al.
2003/0036425 A1 2/2003 Kaminkow et al.
2003/0054868 A1 3/2003 Paulsen et al.
2003/0054878 A1 3/2003 Benoy et al.
2003/0054881 A1 3/2003 Hedrick et al.
2003/0054888 A1 3/2003 Walker et al.
2003/0064788 A1 4/2003 Walker et al.
2003/0064807 A1 4/2003 Walker et al.
2003/0066883 A1 4/2003 Yu
2003/0069071 A1 4/2003 Britt et al.
2003/0109306 A1 6/2003 Karmarker
2003/0141660 A1 7/2003 Colapinto et al.
2003/0148807 A1 8/2003 Acres
2003/0148812 A1 8/2003 Paulsen et al.
2003/0157979 A1 8/2003 Cannon et al.
2003/0171149 A1 9/2003 Rothschild
2003/0176211 A1 9/2003 Sommerville
2003/0186745 A1 10/2003 Nguyen et al.
2003/0195024 A1 10/2003 Slattery
2003/0224852 A1 12/2003 Walker et al.
2004/0002385 A1 1/2004 Nguyen
2004/0039695 A1 2/2004 Rowe
2004/0077397 A1 4/2004 Hosaka
2004/0106449 A1 6/2004 Walker et al.
2004/0110557 A1 6/2004 Rowe
2004/0116183 A1 6/2004 Prindle
2004/0152518 A1 8/2004 Kogo
2004/0166931 A1 8/2004 Criss-Puszkiewicz et al.
2004/0198485 A1 10/2004 Loose et al.
2005/0027381 A1 2/2005 George et al.
2005/0037842 A1 2/2005 Kastner
2005/0059494 A1 3/2005 Kammler
2005/0096124 A1 5/2005 Stronach
2005/0096126 A1 5/2005 Prasad
2005/0124411 A1 6/2005 Schneider
2005/0143169 A1 6/2005 Nguyen et al.
2005/0164779 A1 7/2005 Okuniewicz
2005/0181864 A1 8/2005 Britt et al.
2005/0215316 A1 9/2005 Rowe et al.
2005/0239530 A1* 10/2005 Walker et al. ..... 463/16
2005/0250567 A1 11/2005 Kane et al.
2005/0251440 A1 11/2005 Bednarek
2005/0255911 A1 11/2005 Nguyen et al.
2005/0255922 A1 11/2005 Nguyen et al.
2005/0261059 A1 11/2005 Nguyen et al.
2005/0261060 A1 11/2005 Nguyen et al.
2005/0261061 A1 11/2005 Nguyen et al.
2005/0261913 A1 11/2005 Lapointe
2005/0266919 A1 12/2005 Rowe et al.
2006/0009284 A1 1/2006 Schwartz et al.
2006/0019734 A1 1/2006 Roemer
2006/0019743 A1 1/2006 Roemer
2006/0019744 A1 1/2006 Roemer
2006/0025212 A1 2/2006 Griswold
2006/0035707 A1 2/2006 Nguyen et al.
2006/0046817 A1 3/2006 Paulsen et al.
2006/0046842 A1 3/2006 Mattice et al.
2006/0052150 A1 3/2006 Hedrick et al.
2006/0052169 A1 3/2006 Britt et al.
2006/0059046 A1 3/2006 Mohr et al.
2006/0063580 A1 3/2006 Nguyen et al.
2006/0063587 A1 3/2006 Manzo
2006/0073888 A1 4/2006 Nguyen et al.
2006/0111172 A1 5/2006 Walker et al.

2006/0128460 A1 6/2006 Muir et al.
2006/0142078 A1 6/2006 Walker et al.
2006/0154719 A1 7/2006 Okuniewicz
2006/0154720 A1 7/2006 Okuniewicz
2006/0154723 A1 7/2006 Saffari et al.
2006/0154724 A1 7/2006 Okuniewicz
2006/0154727 A1 7/2006 Okuniewicz
2006/0154730 A1 7/2006 Okuniewicz
2006/0189367 A1 8/2006 Nguyen et al.
2006/0194631 A1 8/2006 Rowe et al.
2006/0199632 A1 9/2006 Thomas et al.
2006/0201775 A1 9/2006 Tedesco et al.
2006/0205485 A1 9/2006 Walker et al.
2006/0211475 A1 9/2006 Walker et al.
2006/0211476 A1 9/2006 Walker et al.
2006/0211477 A1 9/2006 Walker et al.
2006/0211479 A1 9/2006 Walker et al.
2006/0211480 A1 9/2006 Walker et al.
2006/0211493 A1 9/2006 Walker et al.
2006/0217175 A1 9/2006 Walker et al.
2006/0217176 A1 9/2006 Walker et al.
2006/0217190 A1 9/2006 Walker et al.
2006/0223606 A1 10/2006 Walker et al.
2006/0223607 A1 10/2006 Walker et al.
2006/0223608 A1 10/2006 Walker et al.
2006/0223629 A1 10/2006 Walker et al.
2006/0227635 A1 10/2006 Walker et al.
2006/0227636 A1 10/2006 Walker et al.
2006/0229125 A1 10/2006 Walker et al.
2006/0232004 A1 10/2006 Walker et al.
2006/0240887 A1 10/2006 Walker et al.
2006/0240889 A1 10/2006 Walker et al.
2006/0240890 A1 10/2006 Walker et al.
2006/0246984 A1 11/2006 Walker et al.
2006/0246985 A1 11/2006 Walker et al.
2006/0247012 A1 11/2006 Walker et al.
2006/0247016 A1 11/2006 Walker et al.
2006/0247026 A1 11/2006 Walker et al.
2006/0247030 A1 11/2006 Walker et al.
2006/0247035 A1 11/2006 Rowe et al.
2006/0247037 A1 11/2006 Park
2006/0252522 A1 11/2006 Walker et al.
2006/0252524 A1 11/2006 Friesen et al.
2006/0252528 A1 11/2006 Walker et al.
2006/0252534 A1 11/2006 Walker et al.
2006/0258422 A1 11/2006 Walker et al.
2006/0258442 A1 11/2006 Ryan
2006/0259318 A1 11/2006 Walker et al.
2006/0281537 A1 12/2006 Abbott et al.
2006/0281541 A1 12/2006 Nguyen et al.
2006/0287040 A1 12/2006 Walker et al.
2006/0287054 A1 12/2006 Walker et al.
2006/0287071 A1 12/2006 Walker et al.
2006/0287072 A1 12/2006 Walker et al.
2007/0001397 A1 1/2007 Walker et al.
2007/0001398 A1 1/2007 Walker et al.
2007/0004502 A1 1/2007 Walker et al.
2007/0004511 A1 1/2007 Walker et al.
2007/0004518 A1 1/2007 Friesen et al.
2007/0012542 A1 1/2007 Tedesco et al.
2007/0016535 A1 1/2007 Tedesco et al.
2007/0021164 A1 1/2007 Lind et al.
2007/0050256 A1 3/2007 Walker et al.
2007/0060365 A1 3/2007 Tien et al.
2007/0077978 A1 4/2007 Walker et al.
2007/0077981 A1 4/2007 Hungate et al.
2007/0087756 A1 4/2007 Hoffberg
2007/0087831 A1 4/2007 Van Luchene et al.
2007/0087834 A1 4/2007 Moser et al.
2007/0105613 A1 5/2007 Adams et al.
2007/0105617 A1 5/2007 Walker et al.
2007/0105630 A1 5/2007 Van Luchene
2007/0111787 A1 5/2007 Adams et al.
2007/0117612 A1 5/2007 Walker et al.
2007/0129136 A1 6/2007 Walker et al.
2007/0129137 A1 6/2007 Walker et al.
2007/0129141 A1 6/2007 Walker et al.
2007/0129149 A1 6/2007 Walker et al.
2007/0149278 A1 6/2007 Walker et al.
2007/0155465 A1 7/2007 Walker et al.
2007/0155490 A1 7/2007 Phillips et al.
2007/0167209 A1 7/2007 Jaffe et al.
2007/0167210 A1 7/2007 Kelly et al.
2007/0167212 A1 7/2007 Nguyen
2007/0167216 A1 7/2007 Walker et al.
2007/0167226 A1 7/2007 Kelly et al.
2007/0168251 A1 7/2007 Hilbert et al.
2007/0180371 A1 8/2007 Kammler
2007/0197294 A1 8/2007 Gong
2007/0198432 A1 8/2007 Pitroda et al.
2007/0202941 A1 8/2007 Miltenberger et al.
2007/0213124 A1 9/2007 Walker et al.
2007/0233615 A1 10/2007 Tumminaro
2007/0243925 A1 10/2007 Lemay et al.
2007/0243934 A1 10/2007 Little et al.
2007/0244811 A1 10/2007 Tumminaro
2007/0254736 A1 11/2007 Hardy et al.
2007/0255620 A1 11/2007 Tumminaro et al.
2007/0255652 A1 11/2007 Tumminaro et al.
2007/0255653 A1 11/2007 Tumminaro et al.
2007/0255662 A1 11/2007 Tumminaro
2007/0259709 A1 11/2007 Kelly et al.
2007/0270213 A1 11/2007 Nguyen et al.
2007/0271194 A1 11/2007 Walker et al.
2008/0009344 A1 1/2008 Graham et al.
2008/0020848 A1 1/2008 Muir et al.
2008/0026816 A1 1/2008 Sammon et al.
2008/0026823 A1 1/2008 Wolf et al.
2008/0039189 A1 2/2008 Walker et al.
2008/0039190 A1 2/2008 Walker et al.
2008/0039192 A1 2/2008 Laut
2008/0051193 A1 2/2008 Kaminkow et al.
2008/0058086 A1 3/2008 Saffari et al.
2008/0076505 A1 3/2008 Nguyen et al.
2008/0076529 A1 3/2008 Richards et al.
2008/0096645 A1 4/2008 Frerking et al.
2008/0102934 A1 5/2008 Tan
2008/0102935 A1 5/2008 Finnimore
2008/0102947 A1 5/2008 Hays et al.
2008/0108419 A1 5/2008 Dimichele et al.
2008/0108433 A1 5/2008 Dimichele et al.
2008/0113701 A1 5/2008 Schultz et al.
2008/0113702 A1 5/2008 Schultz et al.
2008/0113738 A1 5/2008 Vallejo et al.
2008/0113776 A1 5/2008 Sommer
2008/0113777 A1 5/2008 Anderson
2008/0113784 A1 5/2008 Vallejo et al.
2008/0120221 A1 5/2008 Toneguzzo
2008/0132311 A1 6/2008 Walker
2008/0146322 A1 6/2008 Hardy et al.
2008/0146323 A1 6/2008 Hardy et al.
2008/0146344 A1 6/2008 Rowe et al.
2008/0146345 A1 6/2008 Hardy et al.
2008/0146346 A1 6/2008 Hardy et al.
2008/0153583 A1 6/2008 Huntley et al.
2008/0167118 A1 7/2008 Kroeckel et al.
2008/0167123 A1 7/2008 Luciano et al.
2008/0167130 A1 7/2008 Kroeckel et al.
2008/0171586 A1 7/2008 Roemer
2008/0171602 A1 7/2008 Patel et al.
2008/0176650 A1 7/2008 Wolf et al.
2009/0054148 A1 2/2009 Hardy et al.
2009/0069078 A1 3/2009 Nguyen et al.
2009/0104960 A1 4/2009 Kelly et al.
2009/0124384 A1 5/2009 Smith et al.
2009/0191962 A1 7/2009 Hardy et al.
2010/0029376 A1 2/2010 Hardy et al.
2010/0124973 A1 5/2010 DeWaal et al.
2011/0130188 A1 6/2011 Walker et al.

FOREIGN PATENT DOCUMENTS

GB 2 144 567 3/1985
GB 2 251 112 6/1992
JP 2002018140 1/2002
JP 2002040975 2/2002
JP 2002099819 4/2002
JP 2002273060 9/2002
JP 2003199971 7/2003

| | | | |
|---|---|---|---|
| JP | 2003330397 | | 11/2003 |
| JP | 2004188096 | | 7/2004 |
| JP | 2005323789 | | 11/2005 |
| WO | WO 99/06969 | A1 | 2/1999 |
| WO | WO 00/75824 | A1 | 12/2000 |
| WO | WO 01/69512 | A1 | 9/2001 |
| WO | WO 01/76709 | A1 | 10/2001 |
| WO | WO 01/80962 | A1 | 11/2001 |
| WO | WO 03/044709 | A1 | 5/2003 |
| WO | WO 2004/111893 | A1 | 12/2004 |
| WO | WO 2005/006238 | A1 | 1/2005 |
| WO | WO 2006/002462 | A1 | 1/2006 |
| WO | WO 2006/031766 | A3 | 3/2006 |
| WO | WO 2007/087391 | A2 | 8/2007 |
| WO | WO 2007/087459 | A2 | 8/2007 |
| WO | WO 2007/130464 | A2 | 11/2007 |
| WO | WO 2008/039402 | A2 | 4/2008 |
| WO | WO 2008/060978 | A2 | 5/2008 |

* cited by examiner

GAMING SYSTEM, GAMING DEVICE, AND METHOD PROVIDING ADVERTISING MESSAGES TO PLAYERS BASED ON A DETERMINATION OF A POSITIVE WINNING GAMING SESSION

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Due to the popularity of casinos and wagering games, it is becoming increasingly common for advertisers to present advertisements or promotions in association with gaming devices being played by players in casinos or other venues. Typically, an advertiser pays a casino a certain amount, and the casino enables the advertiser to cause advertisements or promotions to be presented in association with gaming devices located in the casino. This enables the advertiser to present advertisements or promotions to a large number of people and provides the casino with additional revenue. A casino may also present advertisements associated with the casino itself in connection with gaming devices located in the casino.

In one known proposed gaming device configured to operate a wagering game, advertisements are displayed in the wagering game itself. Certain of the symbols utilized in the wagering game and/or certain of the awards provided in the wagering game are associated with the advertiser. In another known proposed gaming device configured to operate a wagering game, advertisements or promotions are provided to players without regard to the wagering game. Put differently, in this known proposed gaming device, the player is presented with advertisements or promotions regardless of the outcome or outcomes of any play or plays of the wagering game of the gaming device. In another known proposed gaming device, advertisements or promotions are constantly provided to the player while the player is playing a wagering game of the gaming device.

In view of the increasing popularity of providing advertisements in conjunction with gaming devices, it is desirable to increase the effectiveness of these advertisements and promotions by providing new manners in which players are presented with such advertisements or promotions in association with gaming devices.

SUMMARY

Various embodiments of the present disclosure provide a gaming system, gaming device, and method providing advertising messages to players based on a determination of a positive winning gaming session. In general, the gaming system of the present disclosure monitors a plurality of plays of at least one wagering game during a designated period. At the end of the designated period, the gaming system determines whether a player of the monitored plays had a positive winning gaming session. If the player had a positive winning gaming session, the gaming system provides at least one advertising message to the player.

In one example embodiment, the gaming system displays at least one wagering game including at least one winning outcome. The at least one wagering game is operable upon a wager by a player. For a plurality of plays of the at least one wagering game, the gaming system determines a quantity of the plays in which the player achieved the at least one winning outcome. If the quantity of the plays in which the player achieved the at least one winning outcome is greater than or equal to a designated quantity of plays, the gaming system provides at least one advertising message to the player.

In another example embodiment, the gaming system displays at least one wagering game including at least one winning outcome. The at least one wagering game is operable upon a wager by a player. For a plurality of plays of the at least one wagering game, the gaming system determines a quantity of the at least one winning outcome achieved by the player in the plays of the at least one wagering game. If the quantity of the at least one winning outcome is greater than or equal to a designated quantity of winning outcomes, the gaming system provides at least one advertising message to the player.

In another example embodiment, the gaming system displays at least one wagering game including at least one winning outcome and at least one losing outcome. The at least one wagering game is operable upon a wager by a player. For a plurality of plays of the at least one wagering game, the gaming system determines a frequency of the at least one winning outcome. The frequency of the at least one winning outcome is based on a quantity of the at least one winning outcome achieved by the player in the plays of the at least one wagering game. If the frequency of the at least one winning outcome is greater than or equal to a designated frequency of winning outcomes, the gaming system provides at least one advertising message to the player.

In another example embodiment, the gaming system displays at least one wagering game including at least one winning outcome. Each winning outcome is associated with an award. The at least one wagering game is operable upon a wager by a player. For at least one play of the at least one wagering game, the gaming system determines an amount of net winnings. The amount of net winnings includes any awards won by the player for achieving the at least one winning outcome minus any wagers placed by the player in the at least one play of the at least one wagering game. if the amount of net winnings is greater than or equal to a designated amount of net winnings, the gaming system provides at least one advertising message to the player.

Additional features and advantages are described herein, and will be apparent from, the following Detailed Description and the Figures.

DETAILED DESCRIPTION

Gaming Device and Electronics

The present disclosure may be implemented in various configurations for gaming machines, gaming devices, or gaming systems, including but not limited to: (1) a dedicated gaming machine, gaming device, or gaming system wherein the computerized instructions for controlling any games (that are provided by the gaming machine or gaming device) are provided with the gaming machine or gaming device prior to delivery to a gaming establishment; and (2) a changeable gaming machine, gaming device, or gaming system wherein the computerized instructions for controlling any games (that are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces), and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling the base or primary game of the present disclosure are communicated from the central server to the gaming device in a thick client configuration and computerized instructions for controlling any secondary or bonus games or functions are executed by a central server in a thin client configuration.

Figure 1A:
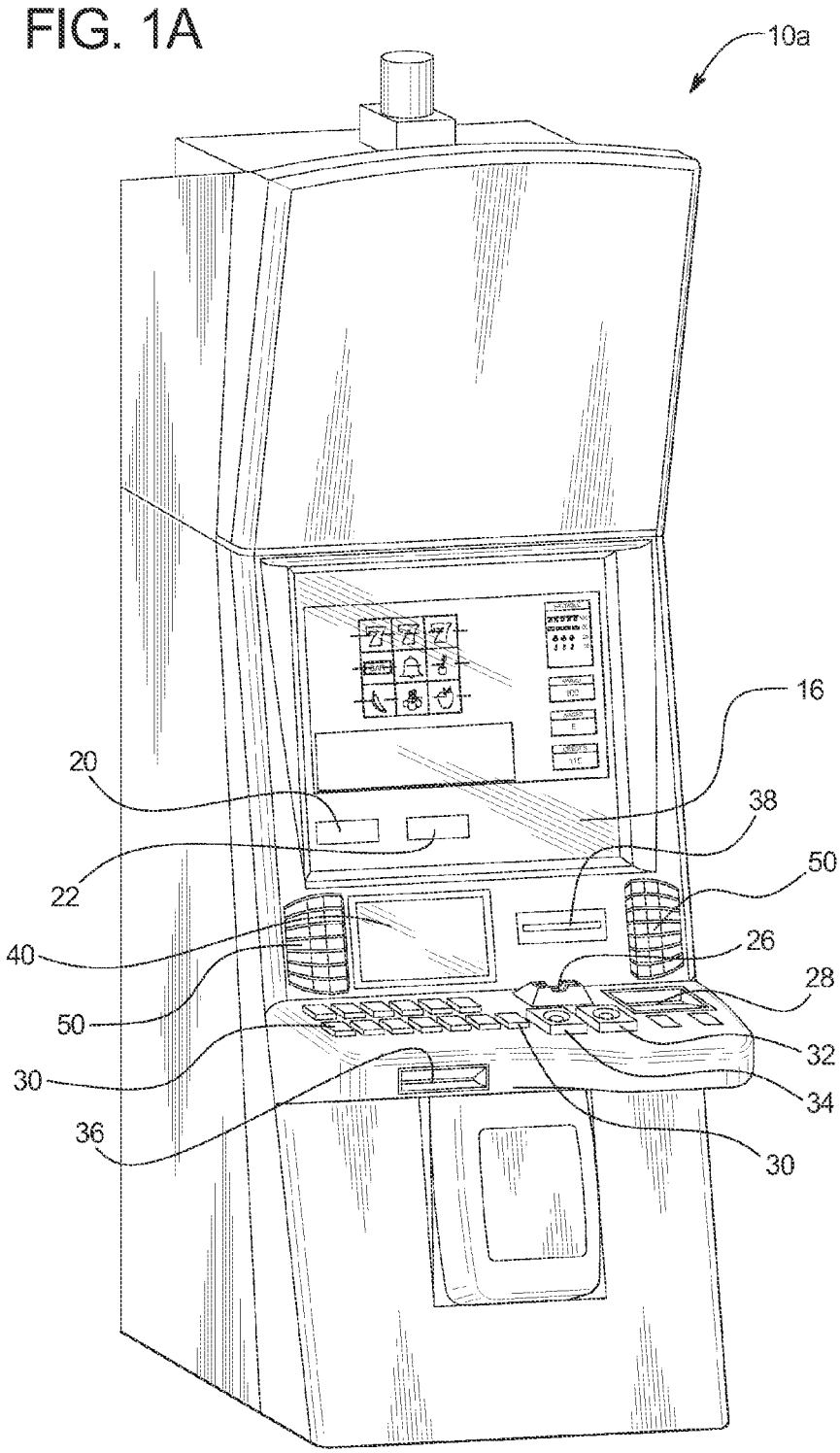
FIGS. 1A and 1B are perspective views of example alternative embodiments of the gaming device of the present disclosure.
Figure 1B:
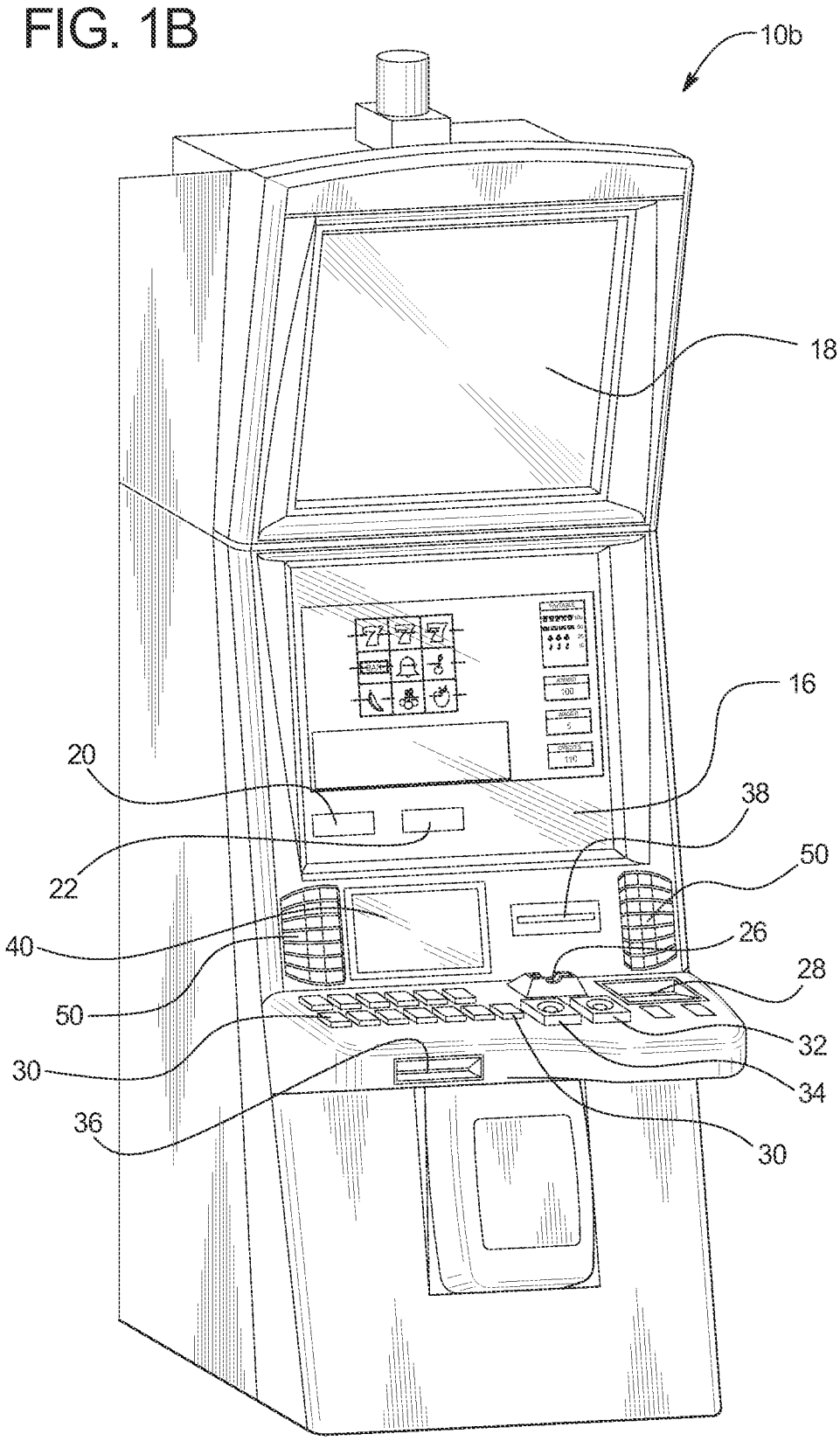

Referring now to the drawings, two example alternative embodiments of a gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing, or cabinet that provides support for a plurality of displays, inputs, controls, and other features of a conventional gaming machine. It is configured so that a player may operate it while standing or sitting. The gaming device may be positioned on a base or stand or may be configured as a pub-style table-top game (not shown) that a player may operate while sitting. As illustrated by the different configurations shown in FIGS. 1A and 1B, the gaming device may have varying cabinet and display configurations.

Figure 2A:
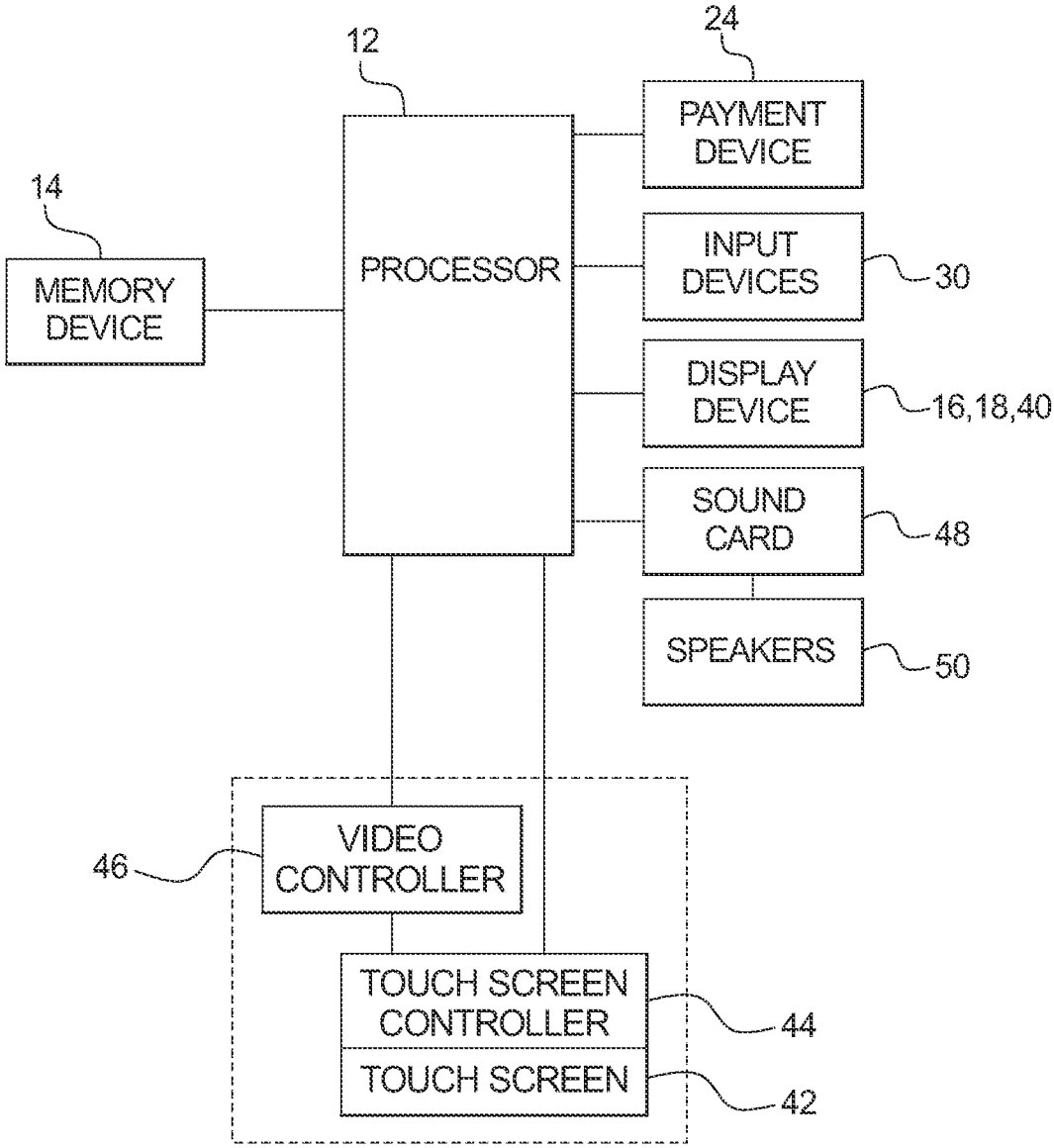
FIG. 2A is a schematic block diagram of one embodiment of an electronic configuration for one of the gaming devices disclosed herein.

In one embodiment, as illustrated in FIG. 2A, the gaming device includes at least one processor 12, such as a microprocessor, a microcontroller-based platform, a suitable integrated circuit, or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information, and applicable game rules that relate to the play of the gaming device. In one embodiment, the memory device includes random access memory (RAM), which may include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above may be stored in a detachable or removable memory device, such as, but not limited to, a suitable cartridge, disk, CD ROM, DVD, or USB memory device. In other embodiments, part or all of the program code and/or operating data described above may be downloaded to the memory device through a suitable network.

In one embodiment, an operator or a player may use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, such as part of a wireless gaming system. In this embodiment, the gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted on the cabinet of the gaming device. The embodiment shown in FIG. 1A includes a central display device 16 that displays any suitable base or primary game. This display device may also display any suitable secondary or bonus game associated with the base or primary game as well as information relating to the base or primary game or the secondary or bonus game. The alternative embodiment shown in FIG. 1B includes a central display device 16 and an upper display device 18. The upper display device may display the base or primary game, any suitable secondary or bonus game associated or not associated with the base or primary game, and/or information relating to the base or primary game or the secondary or bonus game. These display devices may also serve as digital glass operable to advertise games or other aspects of the gaming establishment. As shown in FIGS. 1A and 1B, in one embodiment, the gaming device includes a credit display 20 that displays a player's current number of credits, cash, account balance, or the equivalent. In one embodiment, the gaming device includes a bet display 22 that displays a player's amount wagered. In one embodiment, as discussed in more detail below, the gaming device includes a player tracking display 40 that displays information regarding a player's play tracking status.

In another embodiment, at least one display device may be a mobile display device, such as a PDA or tablet PC, that enables play of at least a portion of the base or primary game or the secondary or bonus game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as discussed in more detail below, the display device includes a touch-screen with an associated touch-screen controller. The display devices may be of any suitable size and configuration, such as a square, a rectangle, an elongated rectangle, an ellipse, or a hexagon.

The display devices of the gaming device are configured to display at least one and in some embodiments a plurality of game or other suitable images, symbols, and indicia such as any visual representation or exhibition of the movement of objects such as mechanical, virtual, or video reels and wheels; dynamic lighting; video images; images of people, characters, places, things, or faces of cards; and the like.

In one alternative embodiment, the symbols, images, and indicia displayed on or of the display device may be in mechanical form. That is, the display device may include any electromechanical device, such as one or more mechanical objects, such as one or more rotatable wheels, reels, or dice, configured to display at least one or a plurality of game or other suitable images, symbols or indicia.

As illustrated in FIG. 2A, in one embodiment, the gaming device includes at least one payment device 24 in communication with the processor. As shown in FIGS. 1A and 1B, a payment device such as a payment acceptor includes a note, ticket, or bill acceptor 28, into which the player inserts paper money, a ticket, or voucher and a coin slot 26 into which the player inserts money, coins, or tokens. In other embodiments, payment devices such as readers or validators for credit cards, debit cards, or credit slips may accept payment. In one embodiment, a player may insert an identification card into a card reader of the gaming device. In one embodiment, the identification card is a smart card having a programmed microchip, a coded magnetic strip, or coded rewritable magnetic strip, wherein the programmed microchip or magnetic strips are coded with a player's identification, credit totals (or related data), and/or other relevant information. In another embodiment, a player may carry a portable device, such as a cell phone, a radio frequency identification tag, or any other suitable wireless device, that communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as discussed above.

As shown in FIGS. 1A, 1B, and 2A, in one embodiment the gaming device includes at least one and in some embodiments a plurality of input devices 30 in communication with the processor. The input devices may include any suitable device that enables the player to produce an input signal that is received by the processor. In one embodiment, after appropriate funding of the gaming device, the input device is a game activation device, such as a play button 32 or a pull arm (not shown) that is used by the player to start the base or primary game or sequence of events in the gaming device. The play button may be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player may increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) that enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier, kiosk, or other suitable redemption system. In another embodiment, when the player cashes out, the player receives the coins or tokens in a coin payout tray. It should be appreciated that any suitable payout mechanisms, such as funding to the player's electronically recordable identification card or smart card, causing an electronic funds transfer to the player's bank account, or crediting the player's casino cash or credit account, may be implemented in accordance with the gaming device disclosed herein.

In one embodiment, as mentioned above and as shown in FIG. 2A, one input device is a touch-screen 42 coupled with a touch-screen controller 44 or some other touch-sensitive display overlay to allow for player interaction with the images on the display. The touch-screen and the touch-screen controller are connected to a video controller 46. A player may make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as shown in FIG. 2A, the gaming device includes a sound generating device controlled by one or more sound cards 48 that function in conjunction with the processor. In one embodiment, the sound generating device includes at least one and in some embodiments a plurality of speakers 50 or other sound generating hardware and/or software for generating sounds, such as by playing music for the base or primary game and/or the secondary or bonus game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera, in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera and to display the visible manifestation of the game in split screen or picture-in-picture fashion. For example, the camera may acquire an image of the player and the processor may incorporate that image into the base or primary game and/or the secondary or bonus game as a game image, symbol, or indicia.

Gaming device 10 incorporates the base or primary game and any secondary or bonus game associated with the base or primary game. The gaming machine or device may include some or all of the features of conventional gaming machines or devices. The gaming device may incorporate any suitable reel-type game, card game, cascading or falling symbol game, number game, or other game of chance susceptible to representation in an electronic or electromechanical form as a secondary or bonus game or feature, which in one embodiment produces a random outcome based on probability data at the time of or after placement of a wager. That is, different base or primary games or secondary or bonus games, such as video poker games, video blackjack games, video keno games, and video bingo games may be implemented.

In one embodiment, the base or primary game and/or the secondary or bonus game includes one or more paylines associated with a plurality of symbol display positions. The paylines may be horizontal, vertical, circular, diagonal, angled, or any combination thereof. In this embodiment, the gaming device includes at least one and in some embodiments a plurality of reels, such as three to five reels, in either electromechanical form with mechanical rotating reels or video form with simulated reels and movement thereof. In one embodiment, an electromechanical slot machine includes a plurality of adjacent, rotatable reels that may be combined and operably coupled with an electronic display of any suitable type. In another embodiment, if the reels are in video form, one or more of the display devices, as discussed above, displays the plurality of simulated video reels. Each reel displays a plurality of indicia or symbols, such as bells, hearts, fruits, numbers, letters, bars, or other images that preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels stop spinning if specified types and/or configurations of indicia or symbols occur on an active payline or otherwise occur in a winning pattern, occur on the requisite number of adjacent reels, and/or occur in a scatter pay arrangement.

In an alternative embodiment, rather than determining any outcome to provide to the player by analyzing the symbols generated on any wagered upon paylines as discussed above, the gaming device determines any outcome to provide to the player based on the number of associated symbols that are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device that enables wagering on ways-to-win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels modifies the number of ways to win.

In another embodiment, the gaming device enables a player to wager on and thus activate symbol positions. In one such embodiment, the symbol positions are on the reels. In this embodiment, if a reel is activated based on the player's wager, then each of the symbol positions of that reel will be activated and each of the active symbol positions will be part of one or more of the ways to win. In one embodiment, if a reel is not activated based on the player's wager, then a designated number of default symbol positions, such as a single symbol position of the middle row of the reel, will be activated and the default symbol position(s) will be part of one or more of the ways to win. This type of gaming machine enables a player to wager on one, more than one, or all of the reels, and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as discussed above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as discussed above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols that form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of two cherry symbols as complete.

After either adding a related symbol to the first string of related symbols or marking the first string of related symbols as complete, the gaming device proceeds as discussed above for each of the remaining classified strings of related symbols that were previously classified or formed from related symbols on the first and second reels.

After analyzing each of the remaining strings of related symbols, the gaming device determines, for each remaining pending or incomplete string of related symbols, if any of the symbols from the next adjacent reel should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to a quantity of awards being based on how many paylines that would have passed through each of the strings of related symbols in active symbol positions).

In one embodiment, base or primary game or the secondary or bonus game may be a poker game wherein the gaming device enables the player to play a conventional game of video draw poker and initially deals five cards all face up from a virtual deck of fifty-two cards. Cards may be dealt as in a traditional game of cards or in the case of the gaming device, the cards may be randomly selected from a predetermined number of cards. If the player wishes to draw, the player selects the cards to hold via one or more input devices, such as by pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table that utilizes conventional poker hand rankings to determine the winning hands. The gaming device provides the player with an award based on a winning hand and the number of credits the player wagered.

In another embodiment, the base or primary game or the secondary or bonus game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand against a payout table and awards are provided to the player.

In one embodiment, the base or primary game or the secondary or bonus game may be a keno game wherein the gaming device displays a plurality of selectable indicia or numbers on at least one of the display devices. In this embodiment, the player selects at least one of a plurality of the selectable indicia or numbers via an input device such as a touch screen. The gaming device then displays a series of drawn numbers and determines an amount of matches, if any, between the player's selected numbers and the gaming device's drawn numbers. The player is provided an award based on the amount of matches, if any, based on the amount of determined matches and the number of numbers drawn.

In one embodiment, as noted above, in addition to winning credits or other awards in the base or primary game, the gaming device may also give players the opportunity to win credits in a secondary or bonus game or in a secondary or bonus round. The secondary or bonus game enables the player to obtain a prize or payout in addition to the prize or payout, if any, obtained from the base or primary game. In general, a secondary or bonus game produces a significantly higher level of player excitement than the base or primary game because it provides a greater expectation of winning than the base or primary game, and is accompanied with more attractive or unusual features than the base or primary game. In one embodiment, the secondary or bonus game may be any type of suitable game, either similar to or completely different from the base or primary game.

In one embodiment, the triggering event or qualifying condition may be a selected outcome in the base or primary game or a particular arrangement of one or more indicia on a display device in the base or primary game, such as a BONUS symbol appearing on three adjacent reels along a payline in the base or primary game. In other embodiments, the triggering event or qualifying condition occurs based on exceeding a certain amount of game play (such as number of games, number of credits, amount of time), or reaching a specified number of points earned during game play.

In another embodiment, gaming device processor 12 or central controller 56 randomly provides the player one or more plays of one or more secondary or bonus games. In one such embodiment, the gaming device does not provide any apparent reason to the player for qualifying to play a secondary or bonus game. In this embodiment, qualifying for a secondary or bonus game is not triggered by an event in or based specifically on any of the plays of the base or primary game. That is, the gaming device may simply qualify a player to play a secondary or bonus game without any explanation or alternatively with simple explanations. In another embodiment, the gaming device (or central server) qualifies a player for a secondary or bonus game at least partially based on a game triggered or symbol triggered event, such as at least partially based on the play of the base or primary game.

In one embodiment, the gaming device includes a program that will automatically begin a secondary or bonus round after the player has achieved a triggering event or qualifying condition in the base or primary game. In another embodiment, after a player has qualified for a secondary or bonus game, the player may subsequently enhance the player's secondary or bonus game participation through continued play of the base or primary game. Thus, for each secondary or bonus qualifying event, such as a bonus symbol, that the player obtains, a given number of secondary or bonus game wagering points or credits may be accumulated in a "bonus meter" programmed to accrue the secondary or bonus wagering credits or entries toward eventual participation in a secondary or bonus game. The occurrence of multiple such secondary or bonus qualifying events in the base or primary game may result in an arithmetic, geometric, or exponential increase in the number of secondary or bonus wagering credits awarded. In one embodiment, the player may redeem extra secondary or bonus wagering credits during the secondary or bonus game to extend play of the secondary or bonus game.

In one embodiment, no separate entry fee or buy-in for a secondary or bonus game is needed. That is, a player may not purchase entry into a secondary or bonus game; rather, the player must win or earn entry through play of the base or primary game, thus encouraging play of the base or primary game. In another embodiment, qualification of the secondary or bonus game is accomplished through a simple "buy-in" by the player—for example, if the player has been unsuccessful at qualifying through other specified activities. In another embodiment, the player must make a separate side-wager on the secondary or bonus game or wager a designated amount in the base or primary game to qualify for the secondary or bonus game. In this embodiment, the secondary or bonus game triggering event must occur and the side-wager (or designated base or primary game wager amount) must have been placed to trigger the secondary or bonus game.

Figure 2B:
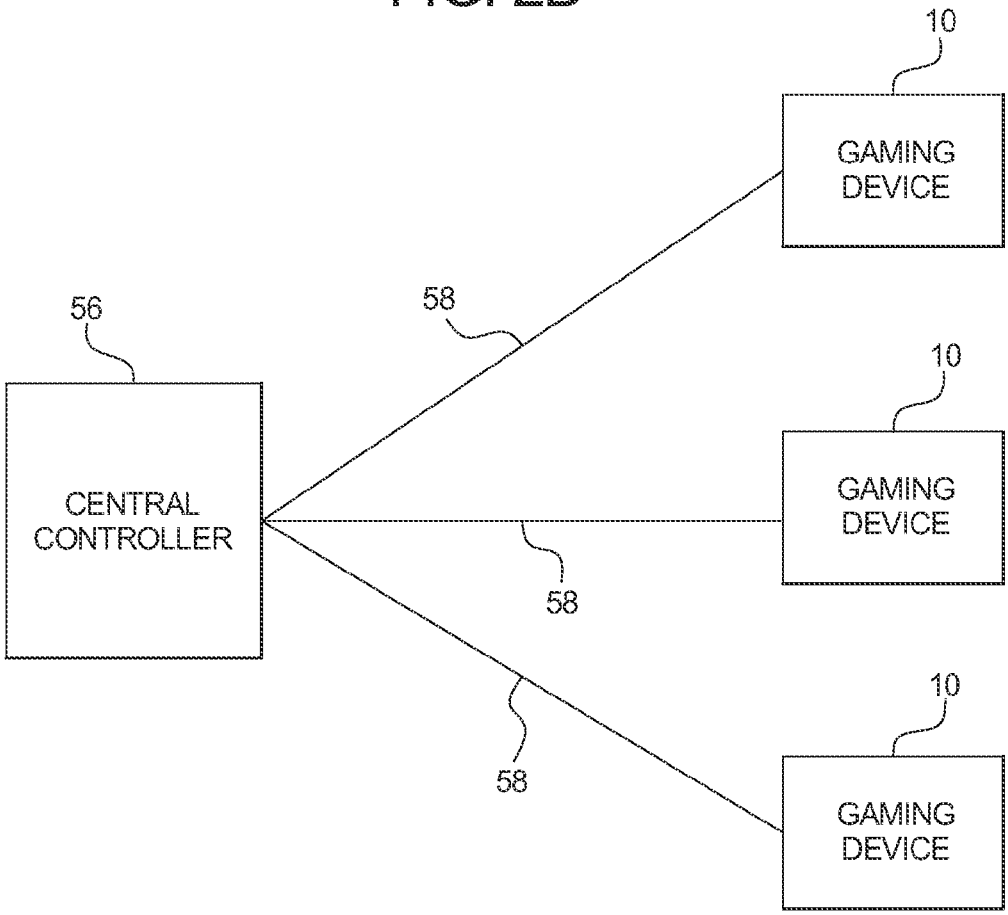
FIG. 2B is a schematic block diagram of one embodiment of a network configuration for a plurality of gaming devices disclosed herein.

In one embodiment, as illustrated in FIG. 2B, one or more of gaming devices 10 are in communication with each other and/or at least one central controller 56 through a data network or remote communication link 58. In this embodiment, the central server, central controller, or remote host is any suitable server or computing device that includes at least one processor and at least one memory or storage device. In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more, or each of the functions of the central controller, central server, or remote host as disclosed herein may be performed by one or more gaming device processors. It should be further appreciated that one, more, or each of the functions of one or more gaming device processors as disclosed herein may be performed by the central controller, central server, or remote host.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the base or primary game based on probability data. In another embodiment, the central server or controller randomly generates a game outcome for the secondary or bonus game based on probability data. In another embodiment, the central server or controller randomly generates a game outcome for both the base or primary game and the secondary or bonus game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome may include a base or primary game outcome, a secondary or bonus game outcome, base or primary game and secondary or bonus game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control may assist a gaming establishment or other entity in maintaining appropriate records, controlling gaming, reducing and preventing cheating or electronic or other errors, reducing or eliminating win-loss volatility, and the like.

In another embodiment, a predetermined game outcome value is determined for each of a plurality of linked or networked gaming devices based on the results of a bingo, keno, or lottery game. In this embodiment, each individual gaming device utilizes one or more bingo, keno, or lottery games to determine the predetermined game outcome value provided to the player for the interactive game played at that gaming device. In one embodiment, the bingo, keno, or lottery game is displayed to the player. In another embodiment, the bingo, keno, or lottery game is not displayed to the player, but the results of the bingo, keno, or lottery game determine the predetermined game outcome value for the base or primary game or the secondary or bonus game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card with each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination may be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As discussed above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10, which will be provided to a first player regardless of how the first player plays in a first game, and a second gaming device to have selected elements marked in a different predetermined pattern is provided a second outcome of win $2, which will be provided to a second player regardless of how the second player plays a second game. It should be appreciated that as the process of marking selected elements continues until one or more predetermined patterns are marked, this embodiment ensures that at least one bingo card will win the bingo game, and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as discussed above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of whether the enrolled gaming device's provided bingo card wins or does not win the bingo game as discussed above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 38 in communication with the processor. In this embodiment, a player is issued a player identification card that has an encoded player identification number that uniquely identifies the player. When a player inserts the player's playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes the player's player tracking card when concluding play for that gaming session. In another embodiment, rather than requiring a player to insert a player tracking card, the gaming device utilizes one or more portable devices carried by a player, such as a cell phone, a radio frequency identification tag, or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks and/or computes any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) that are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. In this embodiment, the operation of the gaming device may be viewed at the gaming device with at least one internet browser or other remote access application. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, wireless connection, WiFi connection, mobile telecommunications network, or other suitable connection. In this embodiment, players may access an internet game page from any location where an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as discussed above, one or more gaming devices are in communication with a central server or controller. The central server or controller may be any suitable server or computing device that includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game that may be played on one or more of the gaming devices in the gaming system. Such different games may include the same or substantially the same game play with different pay tables. In different embodiments, the executable game program is for the base or primary game, a secondary or bonus game, or both. In another embodiment, the game program may be executable as a secondary or bonus game to be played simultaneous with the play of the base or primary game (that may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, WAN, LAN, wireless network, WiFi network, mobile telecommunications network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate the base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city, different cities within a state, or different countries on the planet.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of the base or primary game. That is, a player is provided a progressive award without any explanation or, alternatively, with simple explanations. In another embodiment, a player is provided a progressive award at least partially based on a game triggered or symbol triggered event, such as at least partially based on the play of the base or primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager any credit amount during the base or primary game (i.e., the player need not place the maximum bet and the side bet to be eligible to win one of the progressive awards). In one such embodiment, the greater the player's wager (in addition to or irrespective of the placed side bet), the greater the odds or probability that the player will win one of the progressive awards. It should be appreciated that one or more of the progressive awards may each be funded, at least in part, based on the wagers placed on the base or primary game of the gaming machines in the gaming system, via a gaming establishment or via any suitable manner.

In another embodiment, one or more of the progressive awards are partially funded via a side-bet or side-wager that the player may make (and that may be tracked via a side-bet meter). In one embodiment, one or more of the progressive awards are funded with only side-bets or side-wagers placed. In another embodiment, one or more of the progressive awards are funded based on players' wagers as discussed above as well as any side-bets or side-wagers placed.

In one alternative embodiment, a minimum wager level is required for a gaming device to qualify to be selected to obtain one of the progressive awards. In one embodiment, this minimum wager level is the maximum wager level for the base or primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, among the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Providing Advertising Messages to Players Based on a Determination of a Positive Winning Gaming Session In general, the gaming system, gaming device, and method providing advertising messages to players based on a determination of a positive winning gaming session (sometimes referred to herein as the "gaming system," "gaming device," and/or "method") enables a player to place one or more wagers on one or more plays of a wagering game. The wagering game may be any suitable wagering game such as, but not limited to, a slot or spinning reel game; a video slot or spinning reel game; a video poker, video blackjack, or other card game; a video bingo game; a video keno game; or a video roulette game. During a designated period, the gaming system monitors any plays of the wagering game played by the player. At the end of the designated period, the gaming system determines whether the player had a positive winning gaming session while playing the wagering game. If the player had a positive winning gaming session, the gaming system provides at least one advertising message to the player.

In certain embodiments, the designated period is a period of time. In one of these embodiments, the period of time begins upon the occurrence of any suitable designated start triggering event. In one example, the designated start triggering event occurs when a player deposits money into the gaming system (i.e., puts money into the gaming system, which the gaming system holds as credits, points, currency, or any other suitable account total). In another of these embodiments, the period of time begins when the gaming system is in a cashless or creditless state. It should be appreciated that in various embodiments the designated period of time begins upon any suitable initiation of a gaming session. In one of these embodiments, the period of time ends upon the occurrence of a designated end triggering event. In one example, the designated end triggering event occurs when the player indicates that the player wishes to cash-out of the gaming system. In another one of these embodiments, the period of time is any suitable predetermined period of time, such as thirty minutes or one hour, and the designated end triggering event occurs when the predetermined period of time is extinguished. It should be appreciated that in various embodiments the designated period of time ends upon any suitable completion of a gaming session. In another one of these embodiments, the period of time is determined based on an amount or amounts deposited by the player and/or an amount or amounts of wagers placed by the player. In certain embodiments, the period of time (i.e., the designated period) resets each time the player makes a deposit to the gaming system.

In certain other embodiments, the designated period is a quantity of plays of the wagering game. In one of these embodiments, the quantity of plays of the wagering game is the quantity of plays beginning with the first play of the wagering game after a deposit by the player and ending with the last play of the wagering game before cash-out is requested by the player. In another one of these embodiments, the quantity of plays of the wagering game is predetermined. In another one of these embodiments, the quantity of plays of the wagering game is determined based on an amount or amounts deposited by the player and/or an amount or amounts of wagers placed by the player. In certain embodiments, the quantity of plays of the wagering game (i.e., the designated period) resets each time the player makes a deposit to the gaming system.

In one embodiment, the wagering game includes at least one winning outcome, though it should be appreciated that the wagering game may include a plurality of winning outcomes. In this embodiment, the gaming system determines whether the player had a positive winning gaming session by determining whether a quantity of the monitored plays in which the player achieved the at least one winning outcome is greater than or equal to a designated quantity of monitored plays. In this embodiment, for example, if the player achieves three of the at least one winning outcome in one monitored play of the wagering game and two of the at least one winning outcome in another monitored play of the wagering game, the quantity of the monitored plays in which the player achieved the at least one winning outcome is two.

In this embodiment, the gaming system determines that the player had a positive winning gaming session when the quantity of the monitored plays in which the player achieved the at least one winning outcome is greater than or equal to the designated quantity of monitored plays, and that the player did not have a positive winning gaming session when the quantity of the monitored plays in which the player achieved the at least one winning outcome is less than the designated quantity of monitored plays. In another embodiment, the gaming system determines that the player had a positive winning gaming session when the quantity of the monitored plays in which the player achieved the at least one winning outcome is greater than the designated quantity of monitored plays, and that the player did not have a positive winning outcome when the quantity of the monitored plays in which the player achieved the at least one winning outcome is less than or equal to the designated quantity of monitored plays.

It should be appreciated that the designated quantity of monitored plays may be determined in any suitable manner. In one embodiment, the designated quantity of monitored plays is predetermined. In various other embodiments, the designated quantity of monitored plays is determined based on: (a) an amount of credits or currency input by the player, (b) an amount of credits or currency input by the player over a predetermined period, (c) an amount of credits or currency input by a plurality of players, (d) information stored in a player tracking account associated with the player, (e) information stored in a plurality of player tracking accounts associated with a plurality of players, (f) the quantity of monitored plays, (g) the quantity of winning outcomes and the quantity of losing outcomes included in the wagering game, or (h) any suitable combination thereof.

In another embodiment, the wagering game includes at least one winning outcome, though it should be appreciated that the wagering game may include a plurality of winning outcomes. In this embodiment, the gaming system determines whether the player had a positive winning gaming session by determining whether a quantity of the at least one winning outcome achieved by the player in the monitored plays of the wagering game is greater than or equal to a designated quantity of the at least one winning outcome. The quantity of the at least one winning outcome achieved by the player in the monitored plays of the wagering game is the total quantity of the at least one winning outcome achieved by the player in the monitored plays of the wagering game. If, for example, the player achieves three of the at least one winning outcome in one monitored play of the wagering game and two of the at least one winning outcome in another monitored play of the wagering game, the quantity of the at least one winning outcome achieved by the player in the monitored plays of the wagering game is five in this embodiment.

In this embodiment, the gaming system determines that the player had a positive winning gaming session when the quantity of the at least one winning outcome achieved by the player in the monitored plays of the wagering game is greater than or equal to the designated quantity of the at least one winning outcome, and that the player did not have a positive winning gaming session when the quantity of the at least one winning outcome achieved by the player in the monitored plays of the wagering game is less than the designated quantity of the at least one winning outcome. In another embodiment, the gaming system determines that the player had a positive winning gaming session when the quantity of the at least one winning outcome achieved by the player in the monitored plays of the wagering game is greater than the designated quantity of the at least one winning outcome, and that the player did not have a positive winning outcome when the quantity of the at least one winning outcome achieved by the player in the monitored plays of the wagering game is less than or equal to the designated quantity of the at least one winning outcome.

It should be appreciated that, in various embodiments, the designated quantity of the at least one winning outcome may be determined in any suitable manner. In one embodiment, the designated quantity of the at least one winning outcome is predetermined. In various other embodiments, the designated quantity of the at least one winning outcome is determined based on: (a) an amount of credits or currency input by the player, (b) an amount of credits or currency input by the player over a predetermined period, (c) an amount of credits or currency input by a plurality of players, (d) information stored in a player tracking account associated with the player, (e) information stored in a plurality of player tracking accounts associated with a plurality of players, (f) the quantity of monitored plays, (g) the quantity of winning outcomes and the quantity of losing outcomes included in the wagering game, or (h) any suitable combination thereof.

In another embodiment, the wagering game includes at least one winning outcome and at least one losing outcome, though it should be appreciated that the wagering game may include a plurality of winning outcomes, a plurality of losing outcomes, or both. In this embodiment, the gaming system determines whether the player had a positive winning gaming session by determining whether a frequency of the at least one winning outcome is greater than or equal to a designated frequency of winning outcomes. The frequency of the at least one winning outcome is based on a quantity of the at least one winning outcome achieved in the monitored plays. The gaming system determines that the player had a positive winning gaming session when the frequency of the at least one winning outcome is greater than or equal to the designated frequency of winning outcomes, and that the player did not have a positive winning gaming session when the frequency of the at least one winning outcome is less than the designated frequency of winning outcomes. In another embodiment, the gaming system determines that the player had a positive winning gaming session when the frequency of the at least one winning outcome is greater than the designated frequency of winning outcomes, and that the player did not have a positive winning gaming session when the frequency of the at least one winning outcome is less than or equal to the designated frequency of winning outcomes.

It should be appreciated that the frequency of the at least one winning outcome may be determined in any suitable manner. In one embodiment, the frequency of the at least one winning outcome is equal to the quantity of the monitored plays in which the player achieved at least one winning outcome divided by the total quantity of monitored plays. In another embodiment, the frequency of the at least one winning outcome is equal to the quantity of the at least one winning outcome achieved in the monitored plays divided by the sum of the quantity of the at least one winning outcome achieved in the monitored plays and a quantity of the at least one losing outcome achieved in the monitored plays. In another embodiment, the frequency of the at least one winning outcome is equal to the quantity of the at least one winning outcome achieved in the monitored plays divided by the total quantity of monitored plays.

It should be appreciated that the designated frequency of winning outcomes may be determined in any suitable manner. In one embodiment, the designated frequency of winning outcomes is predetermined. In various other embodiments, the designated frequency of winning outcomes is based on: (a) an amount of credits or currency input by the player, (b) an amount of credits or currency input by the player over a predetermined period, (c) an amount of credits or currency input by a plurality of players, (d) information stored in a player tracking account associated with the player, (e) information stored in a plurality of player tracking accounts associated with a plurality of players, (f) the quantity of monitored plays, (g) the quantity of winning outcomes and the quantity of losing outcomes included in the wagering game, or (h) any suitable combination thereof.

In another embodiment, the wagering game includes at least one winning outcome, each winning outcome being associated with an award, though it should be appreciated that the wagering game may include a plurality of winning outcomes associated with one or more awards. In this embodiment, the gaming system determines whether the player had a positive winning gaming session by determining whether an amount of net winnings is greater than or equal to a designated amount of net winnings. The amount of net winnings includes any awards won by the player in the monitored plays minus any wagers placed by the player in the monitored plays. The gaming system determines that the player had a positive winning gaming session when the amount of net winnings is greater than or equal to the designated amount of net winnings, and that the player did not have a positive winning gaming session when the amount of net winnings is less than the designated amount of net winnings.

It should be appreciated that the designated amount of net winnings may be determined in any suitable manner. In one embodiment, the designated amount of net winnings is predetermined. In various other embodiments, the designated amount of net winnings is determined based on: (a) an amount of credits or currency input by the player, (b) an amount of credits or currency input by the player over a predetermined period, (c) an amount of credits or currency input by a plurality of players, (d) information stored in a player tracking account associated with the player, (e) information stored in a plurality of player tracking accounts associated with a plurality of players, (f) the quantity of monitored plays, (g) the quantity of winning outcomes and the quantity of losing outcomes included in the wagering game, (h) the award values included in the paytable, or (i) any suitable combination thereof.

It should be appreciated that any suitable combination of the above-referenced manners of determining whether the player had a positive winning gaming session may be implemented. In one example, the wagering game includes at least one winning outcome and at least one losing outcome, though it should be appreciated that the wagering game may include a plurality of winning outcomes, a plurality of losing outcomes, or both. The gaming system determines whether the player had a positive winning gaming session by determining: (a) whether a quantity of the at least one winning outcome achieved by the player in the monitored plays of the wagering game is greater than or equal to a designated quantity of the at least one winning outcome, and (b) whether a frequency of the at least one winning outcome is greater than or equal to a designated frequency of winning outcomes. The gaming system determines that the player had a positive winning gaming session when: (a) the quantity of the at least one winning outcome achieved by the player in the monitored plays of the wagering game is greater than or equal to the designated quantity of the at least one winning outcome, and (b) when the frequency of the at least one winning outcome is greater than or equal to the designated frequency of winning outcomes. The gaming system determines that the player did not have a positive winning gaming session when: (a) the quantity of the at least one winning outcome achieved by the player in the monitored plays of the wagering game is less than the designated quantity of the at least one winning outcome, or (b) when the frequency of the at least one winning outcome is less than the designated frequency of winning outcomes.

In another example, the wagering game includes at least one winning outcome and at least one losing outcome, though it should be appreciated that the wagering game may include a plurality of winning outcomes, a plurality of losing outcomes, or both. Each winning outcome is associated with an award. In this embodiment, the gaming system determines whether the player had a positive winning gaming session by determining: (a) whether a frequency of the at least one winning outcome is greater than or equal to a designated frequency of winning outcomes, and (b) an amount of net winnings is greater than or equal to a designated amount of net winnings. The gaming system determines that the player had a positive winning gaming session when: (a) the frequency of the at least one winning outcome is greater than or equal to the designated frequency of winning outcomes, and (b) the amount of net winnings is greater than or equal to the designated amount of net winnings. The gaming system determines that the player did not have a positive winning gaming session when: (a) the frequency of the at least one winning outcome is less than the designated frequency of winning outcomes, or (b) the amount of net winnings is less than the designated amount of net winnings.

In another example, the wagering game includes at least one winning outcome and at least one losing outcome, though it should be appreciated that the wagering game may include a plurality of winning outcomes, a plurality of losing outcomes, or both. Each winning outcome is associated with an award. The gaming system determines whether the player had a positive winning gaming session by determining whether: (a) a quantity of the at least one winning outcome achieved by the player in the monitored plays of the wagering game is greater than or equal to a designated quantity of the at least one winning outcome, (b) a frequency of the at least one winning outcome is greater than or equal to a designated frequency of winning outcomes, and (c) an amount of net winnings is greater than or equal to the designated amount of net winnings. The gaming system determines that the player had a positive winning gaming session when: (a) the quantity of the at least one winning outcome achieved by the player in the monitored plays of the wagering game is greater than or equal to the designated quantity of the at least one winning outcome, (b) the frequency of the at least one winning outcome is greater than or equal to the designated frequency of winning outcomes, and (c) the amount of net winnings is greater than or equal to the designated amount of net winnings. The gaming system determines that the player did not have a positive winning gaming session when: (a) the quantity of the at least one winning outcome achieved by the player in the monitored plays of the wagering game is less than the designated quantity of the at least one winning outcome, or (b) the frequency of the at least one winning outcome is less than the designated frequency of winning outcomes, or (c) the amount of net winnings is greater than or equal to the designated amount of net winnings.

In one embodiment, the at least one advertising message that is provided to the player is at least one of: an interactive message, a non-interactive message, a game trailer, a promotional teaser, an product advertisement or promotion, a gaming system operator advertisement or promotion, a third party advertisement or promotion, an advertisement or promotion for a wagering game nearing a progressive payout, an advertisement or promotion for merchandise, an advertisement or promotion for a movie, a movie trailer, an advertisement or promotion for a casino event, an advertisement or promotion for a wagering game, an advertisement or promotion for any suitable marketable item, and any other suitable advertisement or promotional message. In another embodiment, the advertising message is not associated with the wagering game, any secondary or bonus games associated with the wagering game, or the gaming device on which the wagering game is being played. Put differently, in this embodiment the advertisement is completely independent of the gaming device on which the advertisement is presented to the player. The at least one advertising message could be chosen from a plurality of advertising messages including one or more of the above-listed types of advertising messages. In one embodiment, the interactive message includes one or more free plays of a game and enables the player to play those free plays of the game by making one or more inputs to the gaming system.

In one embodiment, the gaming system provides the at least one advertising message to the player by displaying the at least one advertising message on a primary display device. In another embodiment, the gaming system provides the at least one advertising message to the player by displaying the at least one advertising message on a secondary display device. In another embodiment, the gaming system provides the at least one advertising message to the player by displaying the at least one advertising message on both a primary display device and a secondary display device. In another embodiment, the gaming system provides the at least one advertising message to the player by displaying the at least one advertising message on a player tracking display device. It should be appreciated that the display devices may be any suitable display devices, such as the display devices described above. In another embodiment, the gaming system provides the at least one advertising message to the player by causing an audible advertising message to be played to the player in addition to or instead of the display methods described above. It should be appreciated that the at least one advertising message may be provided to the player in any suitable manner.

The advertising messages may be stored by the gaming system in any suitable manner. In one embodiment, the advertising messages are stored in storage media that is part of the gaming system, such as one of the memory devices described above. In another embodiment, the advertising messages are stored on a server. In another embodiment, the advertising messages are stored in removable media, such as a portable USB drive, a CD, a DVD, or other suitable media. It should be appreciated that the gaming system is configured such that new or additional advertising messages may be added to the stored advertising messages, and such that one or more of the stored advertising messages may be removed from the memory.

In another embodiment, the gaming system enables the player to make a skip advertising message input while the at least one advertising message is being provided. When the player makes the skip advertising message input while the at least one advertising message is being provided, the gaming system stops providing the at least one advertising message. This means that, in this embodiment, if the player does not wish to view or listen to the advertising message, the player may bypass the advertising message by making the skip advertising message input.

In certain other embodiments, a length of the at least one advertising message provided to the player, a quantity of the at least one advertising message provided to the player, or both depend on the positive winning gaming session. For example, in one of these embodiments, the gaming system includes a quantity of different positive winning gaming session levels. Each of these levels is associated with: (a) a different level quantity of the monitored plays in which the player achieved the at least one winning outcome; and (b) a length of time, quantity of advertising messages, or both. The different level quantities are greater than or equal to the designated quantity of monitored plays. As the level quantities increase, the associated length of time and/or quantity of advertising messages increases. In this example, upon cash-out the gaming system determines one of the positive winning gaming session levels by comparing the different level quantities with the quantity of the monitored plays in which the player achieved the at least one winning outcome. The at least one advertising message is then provided to the player based on the length of time, quantity of advertising messages, or both associated with the determined positive winning gaming session level. Thus, in these embodiments, the more positive the player's gaming session, the more the player is provided with advertising messages (in the form of longer advertising messages, a higher quantity of advertising messages, both, or in any other suitable manner).

For example, in one embodiment in which the designated quantity of monitored plays is four, the gaming system includes the following positive winning gaming session levels: (a) Level 1, which is associated with a level quantity of four plays and a quantity of advertising messages of one; (b) Level 2, which is associated with a level quantity of six plays and a quantity of advertising messages of two; (c) Level 3, which is associated with a level quantity of eight plays and a quantity of advertising messages of three; and (d) Level 4, which is associated with a level quantity of ten plays and a quantity of advertising messages of four. In this example, the player played ten monitored plays, seven of which resulted in at least one winning outcome. Thus, in this example embodiment, the gaming system determines a positive winning gaming session level of Level 2 because the seven monitored plays in which the player achieved the at least one winning outcome is greater than or equal to the level quantity of six associated with Level 2 and less than the level quantity of eight associated with Level 3. Therefore, the gaming system provides the player with two advertising messages upon cash-out.

It should be appreciated that the gaming system may utilize any suitable quantity of positive winning gaming session levels. It should also be appreciated that the positive winning gaming session levels may be associated with any level quantity, any suitable length or period of time, and any suitable quantity of advertising messages. It should further be appreciated that the above-described embodiment of the gaming system including positive winning gaming session levels may be similarly applied to the embodiments described above in which the positive winning gaming session is based on one or more of: a designated quantity of the monitored plays in which the player achieved at least one winning outcome, a quantity of the at least one winning outcome achieved by the player in the monitored plays, a frequency of the at least one winning outcome, and an amount of net winnings.

FIGS. 3A, 3B, 3C, 3D, 3E, 3F, 3G, and 3H illustrate screen shots of one example of the gaming system, gaming device, and method of one embodiment of the present disclosure, as generally described above. In this embodiment, the designated period is a period of time that begins when a player makes a deposit to the gaming system and ends when the player cashes out of the gaming system. The wagering game in this example is a spinning reel type game that includes a plurality of different symbols displayable at a plurality of symbol display areas.

In this embodiment, a display device 120 adjacently displays symbol display areas 140*a*, 140*b*, 140*c*, 140*d*, 140*e*, 140*f*, 140*g*, 140*h*, and 140*i* in a 3×3 grid or matrix. It should be appreciated that the display device may display any suitable quantity of symbol display areas in any suitable configuration or arrangement. Display device 120 displays a plurality of paylines, each of which is associated with a different plurality of the symbol display areas. Specifically, payline A 162*a* is associated with symbol display areas 140*a*, 140*b*, and 140*c*; payline B 162*b* is associated with symbol display areas 140*d*, 140*e*, and 140*f*; and payline C 162*c* is associated with symbol display areas 140*g*, 140*h*, and 140*i*. For clarity and brevity, payline A 162*a*, payline B 162*b*, and payline C 162*c* are sometimes referred to herein as paylines A, B, and C. It should be appreciated that the display device may display any suitable quantity of paylines. It should also be appreciated that each of the displayed paylines may be associated with any suitable quantity of the symbol display areas. It should further be appreciated that each of the displayed paylines may be associated with any suitable combination of the symbol display areas.

Display device 120 displays a paytable 132 that includes a plurality of winning symbol combinations. Paytable 132 indicates the credit payout associated with each respective winning symbol combination. In this illustrated embodiment, paytable 132 indicates the credit payout associated with each respective winning symbol combination when the maximum wager, which is 5 credits in this embodiment, is placed by a player for a play of the wagering game. More specifically, winning symbol combination SEVEN-SEVEN-SEVEN is associated with an award of 1,000 credits; winning symbol combination BAR-BAR-BAR is associated with an award of 500 credits; winning symbol combination TRIPLE CHERRY-TRIPLE CHERRY-TRIPLE CHERRY is associated with an award of 100 credits; and winning symbol combination CHERRY-CHERRY-CHERRY is associated with an award of 25 credits.

It should be appreciated that the paytable may be modified to reflect lower credit payouts when a wager that is less than the maximum wager is placed by the player. It should be appreciated that any suitable paytable including any suitable quantity of winning symbol combinations may be used. It should also be appreciated that any suitable combinations of the symbols may be used as winning symbol combinations. It should further be appreciated that the winning symbol combinations may be associated with any suitable credit payouts. It should be appreciated that any suitable quantity of paytables may be used. It should also be appreciated that any suitable symbols may be used. The symbols may include, for example, any suitable markings or indicia such as letters, numbers, or illustrations or pictures of objects, animals, humans, faces, or structures.

Display device 130 displays an award indicator or display 138, which indicates any award a player has won during a play of the wagering game; a wager indicator or display 136, which indicates any wager placed by the player for a play of the wagering game; a credit indicator or display 134, which indicates the player's credit balance; and an indication or dialog box 130, which displays instructions or comments related to the wagering game during, before, and/or after play of the wagering game. It should be appreciated that, in certain embodiments, the display device displays one or a plurality of the award indicator, the wager indicator, the credit indicator, and the indication box.

Figure 3A:
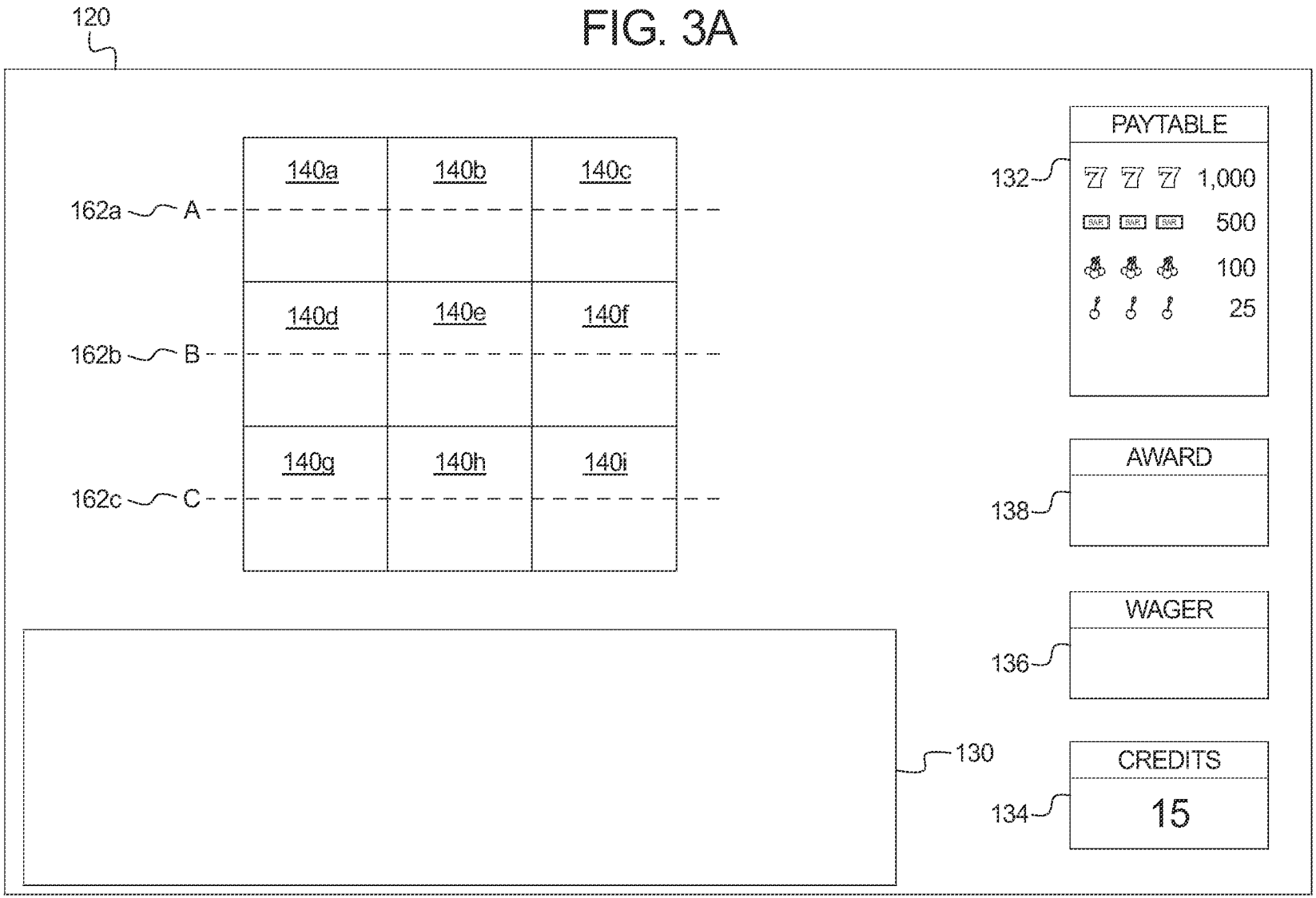
FIGS. 3A, 3B, 3C, 3D, 3E, 3F, 3G, and 3H are front views of a display device of a gaming system or gaming device of one embodiment of the present disclosure and illustrate a plurality of example plays of the gaming system or gaming device providing advertising messages to players based on a determination of a positive winning gaming session.

As illustrated in FIG. 3A, a player deposits currency and is provided with credits that are used to place wagers on the wagering game. In this example, the player deposits currency and is provided with 15 credits associated with that deposited currency. The credits are displayed in credit indicator 134. The designated time period begins upon this deposit and ends upon cash-out. That is, any plays of the wagering game played by the player after deposit and prior to cash-out are monitored by the gaming system (i.e., occur within the designated time period). The gaming system monitors these plays of the wagering game to determine whether the player had a positive winning gaming session during play of these monitored plays. In this example embodiment, the gaming system determines that the player had a positive winning gaming session when the quantity of the monitored plays in which the player achieved the at least one of the winning symbol combinations in paytable 132 is greater than or equal to four (i.e., the designated quantity of monitored plays is equal to four in this example embodiment).

Figure 3B:
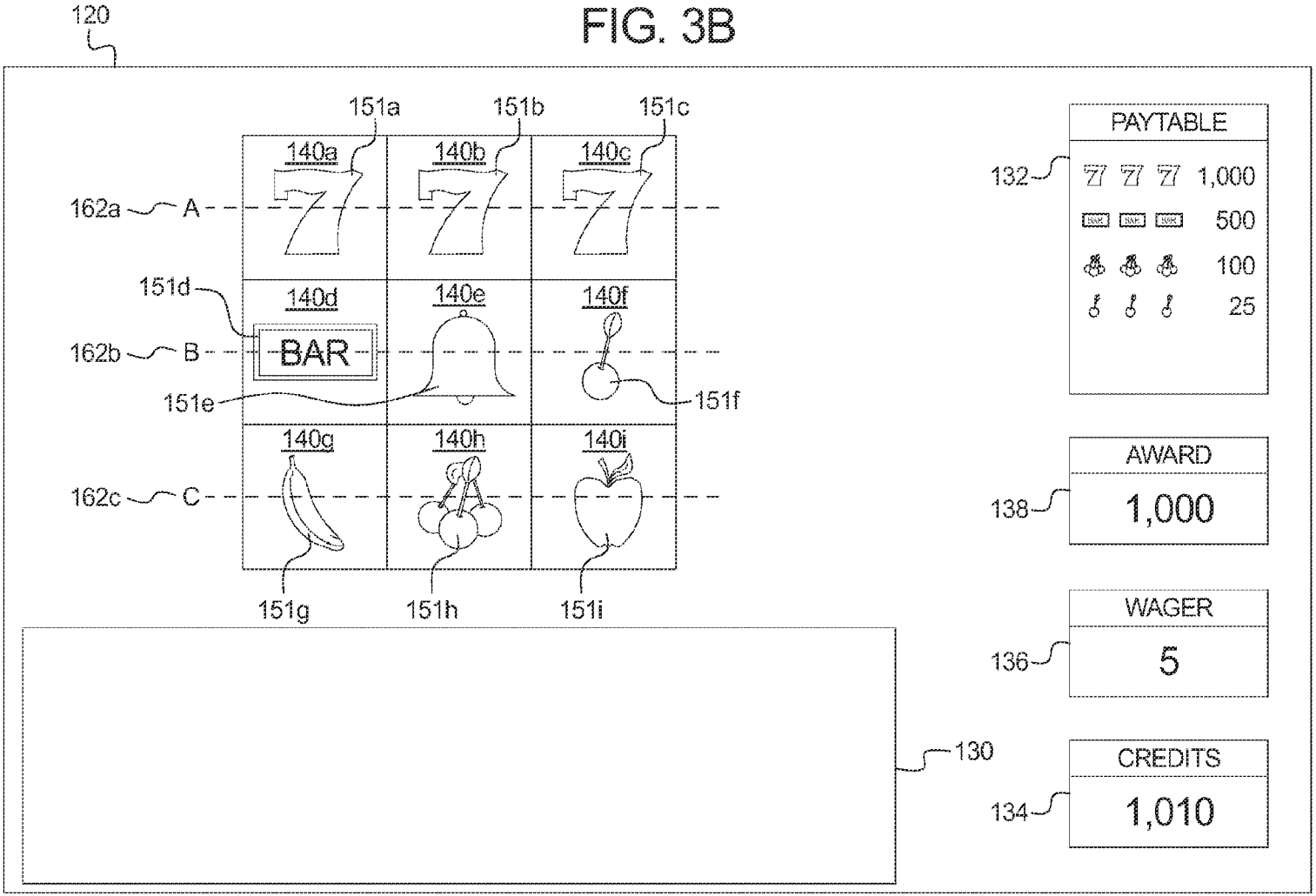

As illustrated in FIG. 3B, the player begins play of the wagering game by placing a wager on one or more of paylines A, B, and C. In this embodiment, the player places the maximum wager of 5 credits, which activates each of paylines A, B, and C. The player's wager of 5 credits is indicated in wager indicator 136. The gaming system randomly generates symbols 151*a*, 151*b*, 151*c*, 151*d*, 151*e*, 151*f*, 151*g*, 151*h*, and 151*i* at symbol display areas 140*a*, 140*b*, 140*c*, 140*d*, 140*e*, 140*f*, 140*g*, 140*h*, and 140*i*, respectively. Only payline A is associated with a winning symbol combination in this example. Specifically, consecutive symbol display areas 140*a*, 140*b*, and 140*c* along payline A each display SEVEN symbols 151*a*, 151*b*, and 151*c*, respectively. As indicated in paytable 132, the player wins an award of 1,000 credits for the displayed SEVEN-SEVEN-SEVEN winning symbol combination, and the award is displayed in award indicator 138. The player's credit balance increases to 1,010 credits, which reflects the player's initial credit balance of 15 credits minus the player's wager of 5 credits plus the player's award of 1,000 credits, as indicated by credit indicator 134. Since the player achieved at least one of the winning symbol combinations of paytable 132 in this monitored play of the wagering game, the quantity of the monitored plays in which the player achieved the at least one winning outcome is set to one.

Figure 3C:
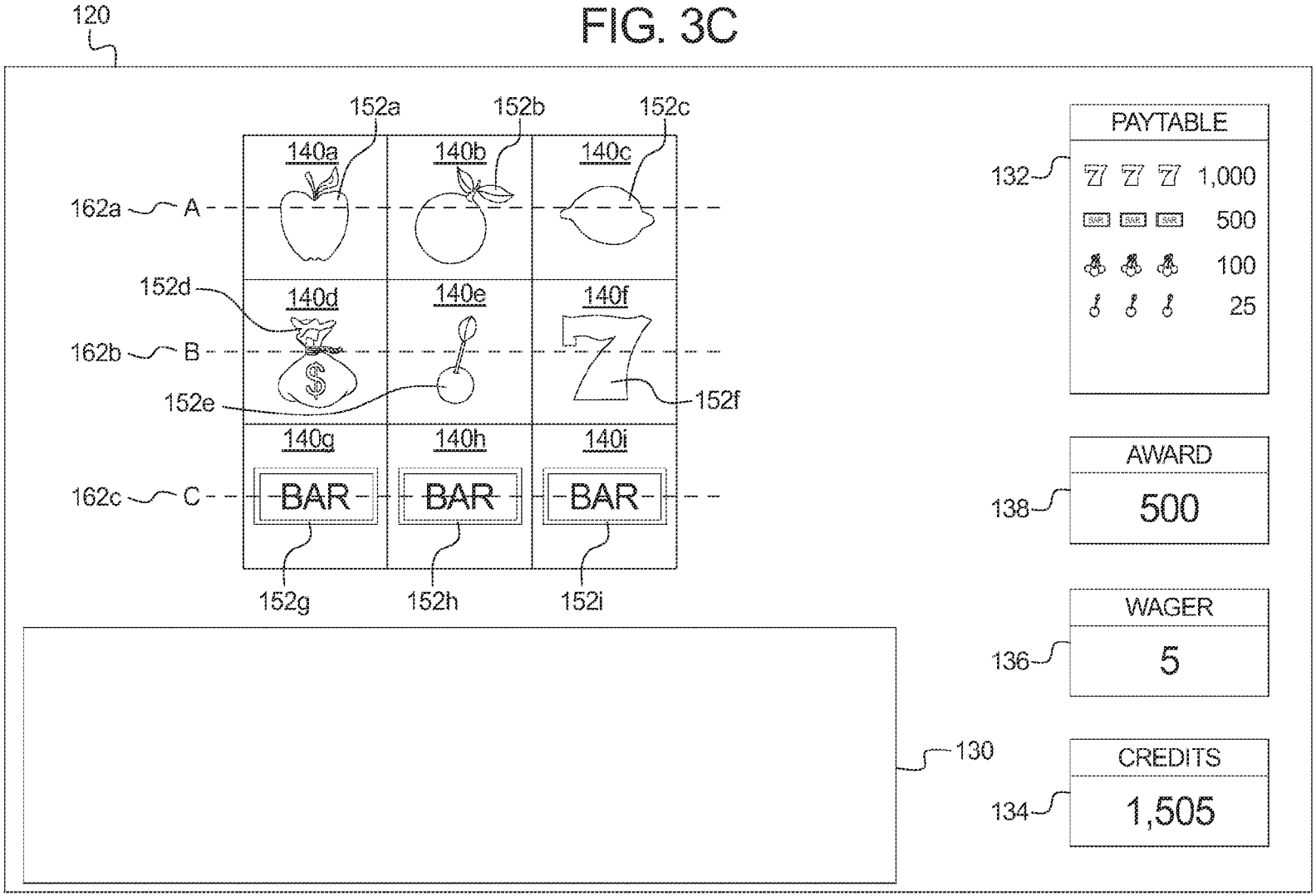

As illustrated in FIG. 3C, the player begins another play of the wagering game by placing the maximum wager of 5 credits, which activates each of paylines A, B, and C. The player's wager of 5 credits is indicated in wager indicator 136. The gaming system randomly generates symbols 152*a*, 152*b*, 152*c*, 152*d*, 152*e*, 152*f*, 152*g*, 152*h*, and 152*i* at symbol display areas 140*a*, 140*b*, 140*c*, 140*d*, 140*e*, 140*f*, 140*g*, 140*h*, and 140*i*, respectively. Only payline C is associated with a winning symbol combination in this example. Specifically, consecutive symbol display areas 140*g*, 140*h*, and 140*i* along payline C each display BAR symbols 152*g*, 152*h*, and 152*i*, respectively. As indicated in paytable 132, the player wins an award of 500 credits for the displayed BAR-BAR-BAR winning symbol combination, and the award is displayed in award indicator 138. The player's credit balance increases to 1,505 credits, which reflects the player's initial credit balance of 1,010 credits minus the player's wager of 5 credits plus the player's award of 500 credits, as indicated by credit indicator 134. Since the player achieved at least one of the winning symbol combinations of paytable 132 in this monitored play of the wagering game, the quantity of the monitored plays in which the player achieved the at least one winning outcome is increased to two.

Figure 3D:
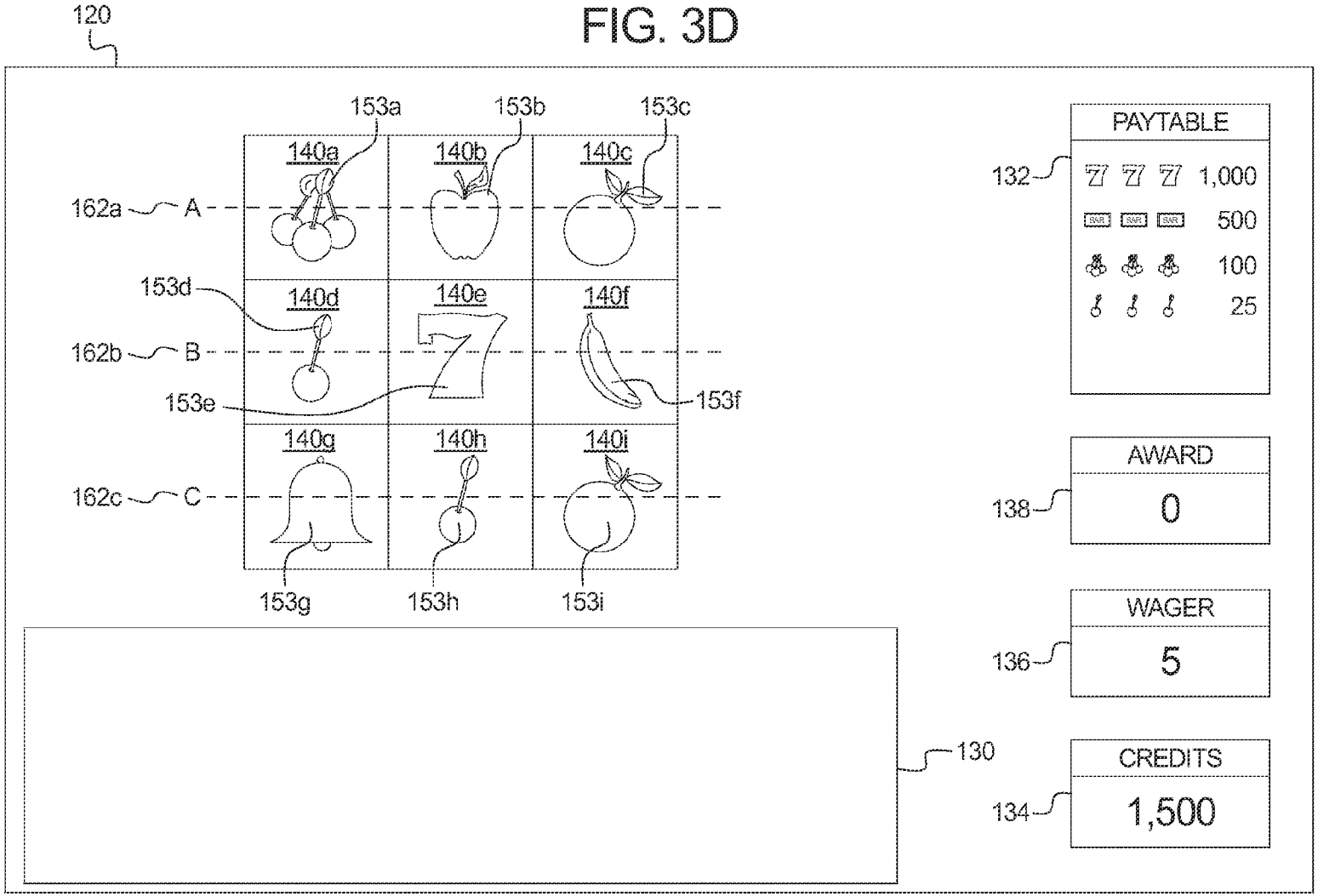

As illustrated in FIG. 3D, the player begins another play of the wagering game by placing the maximum wager of 5 credits, which activates each of paylines A, B, and C. The player's wager of 5 credits is indicated in wager indicator 136. The gaming system randomly generates symbols 153*a*, 153*b*, 153*c*, 153*d*, 153*e*, 153*f*, 153*g*, 153*h*, and 153*i* at symbol display areas 140*a*, 140*b*, 140*c*, 140*d*, 140*e*, 140*f*, 140*g*, 140*h*, and 140*i*, respectively. None of the paylines are associated with a winning symbol combination in this example. An award of 0 credits is displayed in award indicator 138. The player's credit balance decreases to 1,500 credits, which reflects the player's initial credit balance of 1,505 credits minus the player's wager of 5 credits, as indicated by credit indicator 134. Since the player did not achieve at least one of the winning symbol combinations of paytable 132 in this monitored play of the wagering game, the quantity of the monitored plays in which the player achieved the at least one winning outcome remains at two.

Figure 3E:
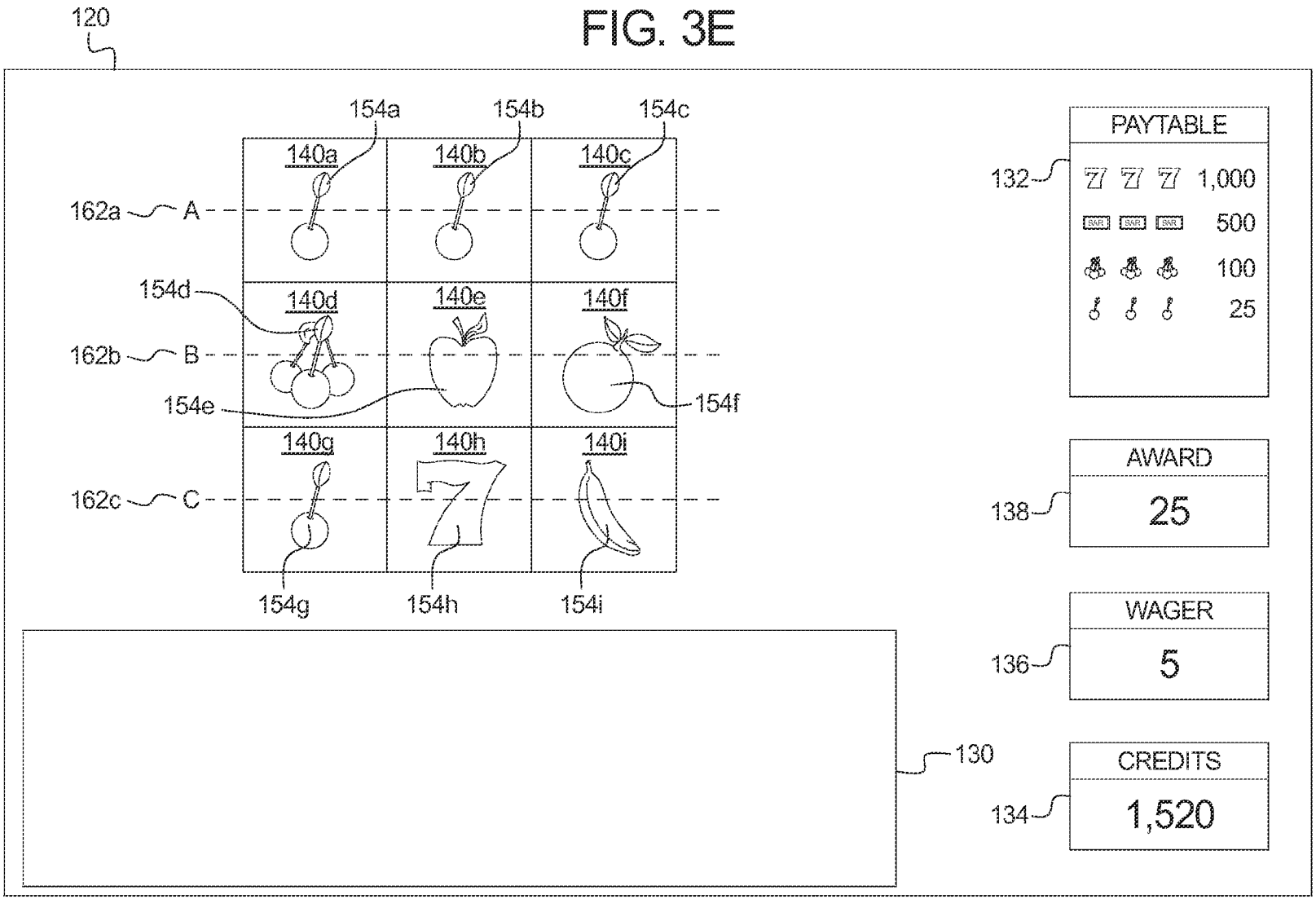

As illustrated in FIG. 3E, the player begins another play of the wagering game by placing the maximum wager of 5 credits, which activates each of paylines A, B, and C. The player's wager of 5 credits is indicated in wager indicator 136. The gaming system randomly generates symbols 154*a*, 154*b*, 154*c*, 154*d*, 154*e*, 154*f*, 154*g*, 154*h*, and 154*i* at symbol display areas 140*a*, 140*b*, 140*c*, 140*d*, 140*e*, 140*f*, 140*g*, 140*h*, and 140*i*, respectively. Only payline A is associated with a winning symbol combination in this example. Specifically, consecutive symbol display areas 140*a*, 140*b*, and 140*c* along payline A each display CHERRY symbols 154*a*, 154*b*, and 154*c*, respectively. As indicated in paytable 132, the player wins an award of 25 credits for the displayed CHERRY-CHERRY-CHERRY winning symbol combination, and the award is displayed in award indicator 138. The player's credit balance increases to 1,520 credits, which reflects the player's initial credit balance of 1,500 credits minus the player's wager of 5 credits plus the player's award of 25 credits, as indicated by credit indicator 134. Since the player achieved at least one of the winning symbol combinations of paytable 132 in this monitored play of the wagering game, the quantity of the monitored plays in which the player achieved the at least one winning outcome is increased to three.

Figure 3F:
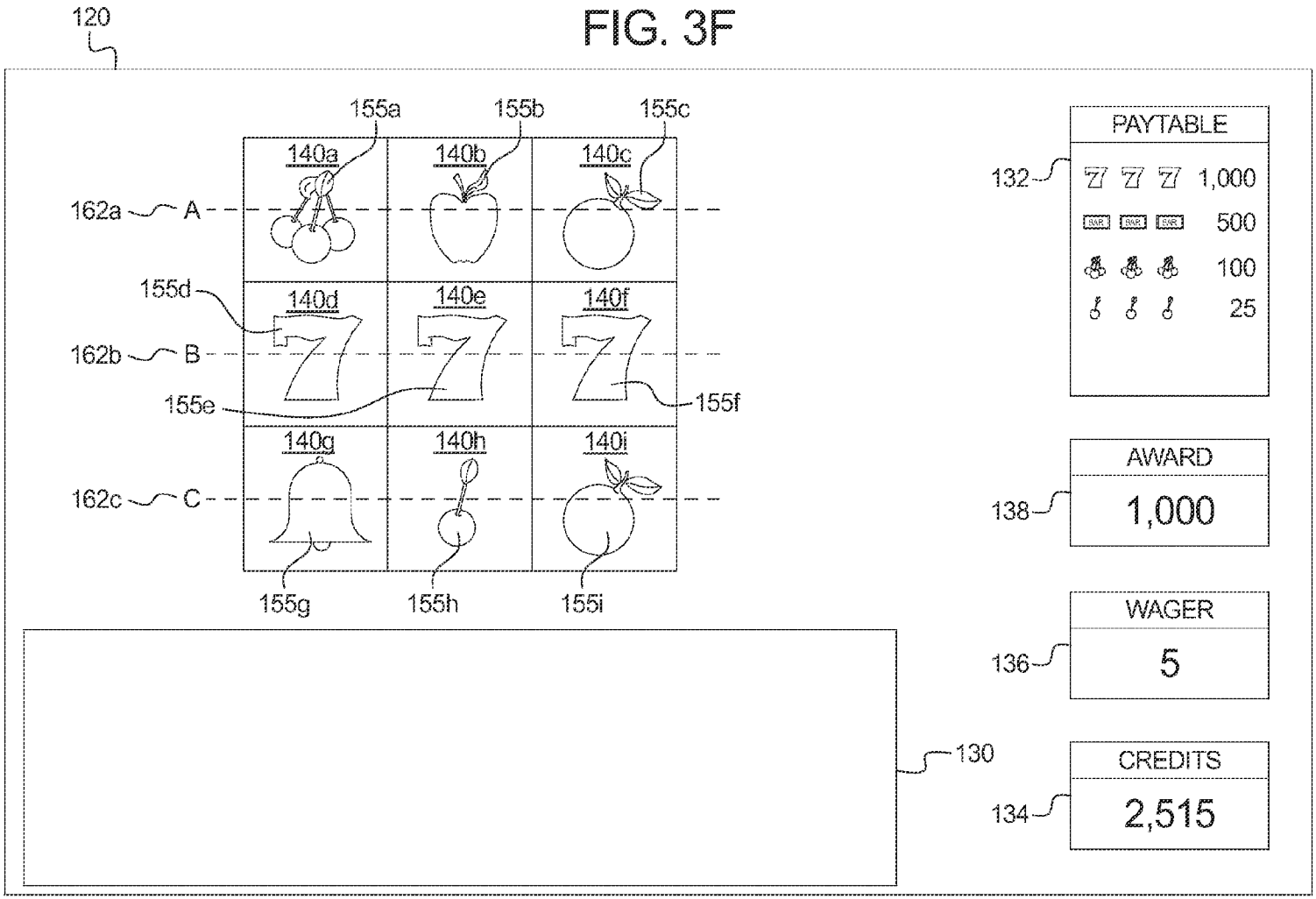

As illustrated in FIG. 3F, the player begins another play of the wagering game by placing the maximum wager of 5 credits, which activates each of the paylines A, B, and C. The player's wager of 5 credits is indicated in wager indicator 136. The gaming system randomly generates symbols 155*a*, 155*b*, 155*c*, 155*d*, 155*e*, 155*f*, 155*g*, 155*h*, and 155*i* at symbol display areas 140*a*, 140*b*, 140*c*, 140*d*, 140*e*, 140*f*, 140*g*, 140*h*, and 140*i*, respectively. Only payline B is associated with a winning symbol combination in this example. Specifically, consecutive symbol display areas 140*d*, 140*e*, and 140*f* along payline B each display SEVEN symbols 155*d*, 155*e*, and 155*f*, respectively. As indicated in paytable 132, the player wins an award of 1,000 credits for the displayed SEVEN-SEVEN-SEVEN winning symbol combination, and the award is displayed in award indicator 138. The player's credit balance increases to 2,515 credits, which reflects the player's initial credit balance of 1,520 credits minus the player's wager of 5 credits plus the player's award of 1,000 credits, as indicated by credit indicator 134. Since the player achieved at least one of the winning symbol combinations of paytable 132 in this monitored play of the wagering game, the quantity of the monitored plays in which the player achieved the at least one winning outcome increases to four.

Figure 3G:
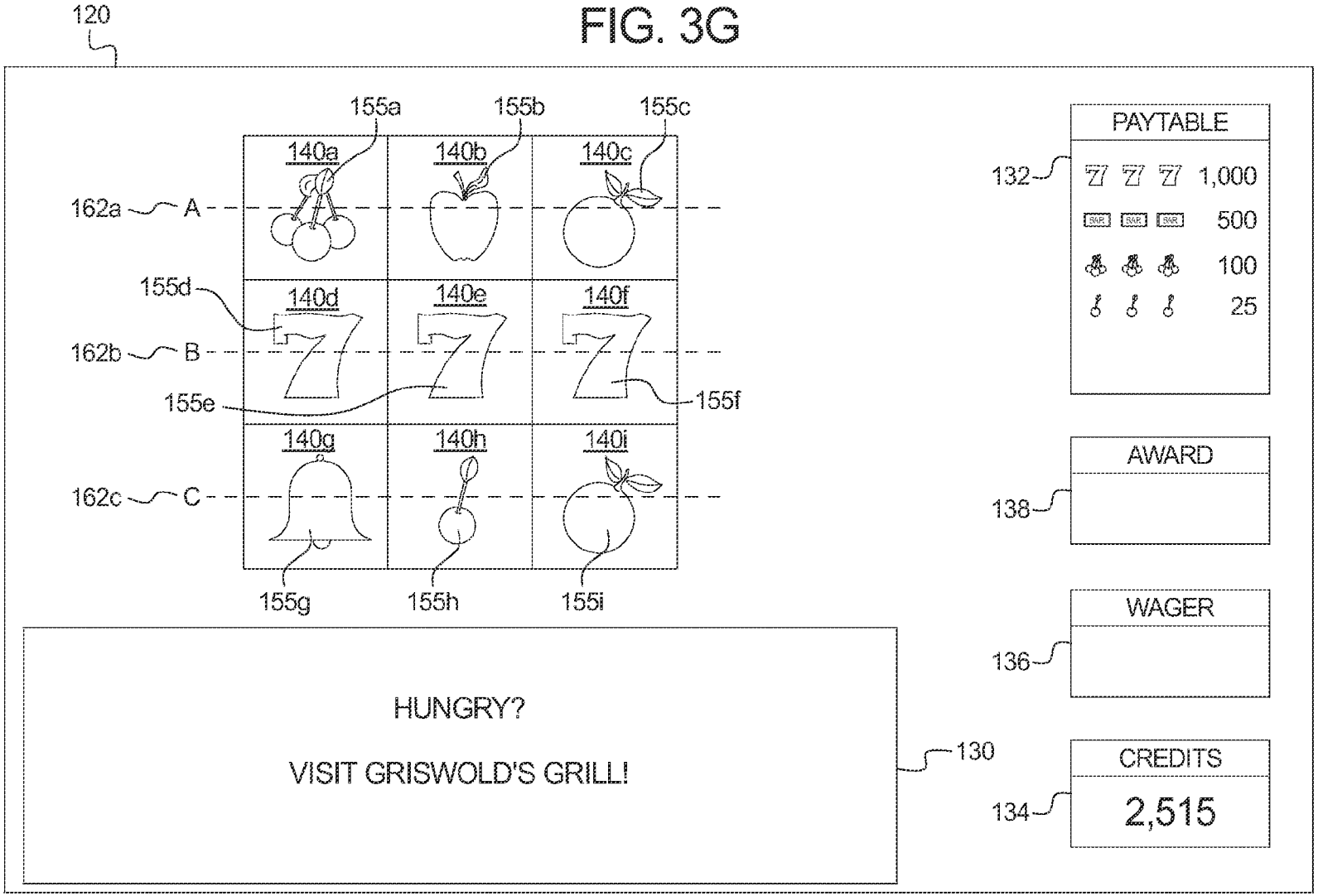
Figure 3H:
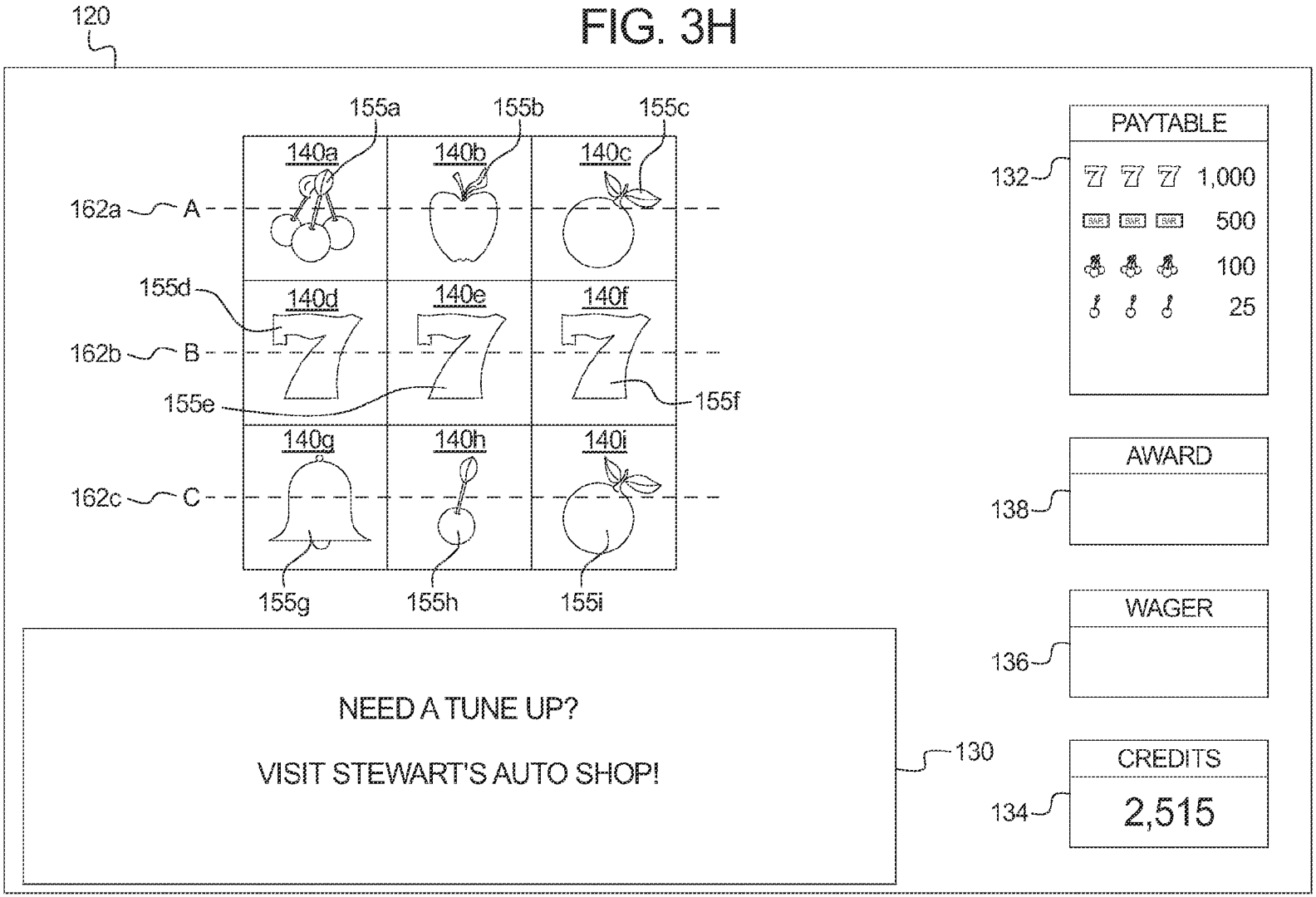

At this point, the player wishes to cash out of the gaming system and accordingly makes a cash out input to the gaming system. After the player makes the cash out input, the gaming system determines whether the quantity of the monitored plays in which the player achieved the at least one winning outcome is greater than or equal to four (i.e., the designated quantity of monitored plays, in this embodiment). Since the quantity of the monitored plays in which the player achieved the at least one winning outcome is equal to four, the gaming system determines that the player had a positive winning gaming session during the monitored plays of the wagering game. Accordingly, as shown in FIG. 3G, the gaming system displays an advertisement to the player in indication box 130 prior to providing payment for the player's credits. FIG. 3H shows another example advertisement in indication box 130 that may be shown to the player prior to providing payment for the player's credits.

In another embodiment, the gaming system determines whether the player had a positive winning gaming session by determining whether a quantity of the winning outcomes achieved by the player in the monitored plays of the wagering game is greater than or equal to a designated quantity of the winning outcomes. In the sequence of plays of the wagering game described above with respect to FIGS. 3A, 3B, 3C, 3D, 3E, and 3F, the player achieved four total winning outcomes (one winning outcome in each of the plays shown in FIGS. 3B, 3C, 3E, and 3F). Thus, in this embodiment, since the quantity of winning outcomes achieved by the player in the monitored plays of the wagering game is four, the gaming system would determine that the player had a positive winning gaming session if the designated quantity of the winning outcomes is less than or equal to four.

In another embodiment, the gaming system determines whether the player had a positive winning gaming session by determining whether a frequency of the winning outcomes is greater than or equal to a designated frequency of winning outcomes. In this embodiment, the frequency of the winning outcomes is equal to the quantity of the monitored plays in which the player achieved at least one winning outcome divided by the total quantity of monitored plays. In the sequence of plays of the wagering game described above with respect to FIGS. 3A, 3B, 3C, 3D, 3E, and 3F, the player achieved one of the winning outcomes in four of the five monitored plays (one winning outcome in the plays shown in FIGS. 3B, 3C, 3E, and 3F). Accordingly, the frequency of the winning outcomes in this example is 80% (four monitored plays in which at least one winning outcome was achieved divided by five total monitored plays). Thus, in this embodiment, since the frequency of the winning outcomes achieved by the player in the monitored plays of the wagering game is 80%, the gaming system would determine that the player had a positive winning gaming session if the designated frequency of winning outcomes is less than or equal to 80%.

In another embodiment, the gaming system determines whether the player had a positive winning gaming session by determining whether a frequency of the winning outcomes is greater than or equal to a designated frequency of winning outcomes. In this embodiment, the frequency of the winning outcomes is equal to the quantity of the winning outcomes achieved in the monitored plays divided by the sum of the quantity of the winning outcomes achieved in the monitored plays and a quantity of the losing outcomes achieved in the monitored plays. In the sequence of plays of the wagering game described above with respect to FIGS. 3A, 3B, 3C, 3D, 3E, and 3F, the player achieved four total winning outcomes (one winning outcome in the plays shown in FIGS. 3B, 3C, 3E, and 3F) and eleven total losing outcomes (two each in the plays shown in FIGS. 3B, 3C, 3E, and 3F, and three in the play shown in FIG. 3D). Accordingly, the frequency of the winning outcomes in this example is 26.67% (four total winning outcomes divided by fifteen total winning and losing outcomes). Thus, in this embodiment, since the frequency of the winning outcomes achieved by the player in the monitored plays of the wagering game is 26.67%, the gaming system would determine that the player had a positive winning gaming session if the designated frequency of winning outcomes is less than or equal to 26.67%.

In another embodiment, the gaming system determines whether the player had a positive winning gaming session by determining whether a frequency of the winning outcomes is greater than or equal to a designated frequency of winning outcomes. In this embodiment, the frequency of the winning outcomes is equal to the quantity of the winning outcomes achieved in the monitored plays divided by the total quantity of monitored plays. In the sequence of plays of the wagering game described above with respect to FIGS. 3A, 3B, 3C, 3D, 3E, and 3F, the player achieved one of the winning outcomes in four of the five monitored plays (one winning outcome in each of the plays shown in FIGS. 3B, 3C, 3E, and 3F). Accordingly, the frequency of the winning outcomes in this example is 80% (four total winning outcomes divided by five monitored plays). Thus, in this embodiment, since the frequency of the winning outcomes achieved by the player in the monitored plays of the wagering game is 80%, the gaming system would determine that the player had a positive winning gaming session if the designated frequency of winning outcomes is less than or equal to 80%.

In another embodiment, the gaming system determines whether the player had a positive winning gaming session by determining whether an amount of net winnings is greater than or equal to a designated amount of net winnings. The amount of net winnings includes any awards won by the player in the monitored plays minus any wagers placed by the player in the monitored plays. In the sequence of plays of the wagering game described above with respect to FIGS. 3A, 3B, 3C, 3D, 3E, and 3F, the player placed wagers totaling 25 credits (5 credits for each play of the game shown in FIGS. 3B, 3C, 3D, 3E, and 3F) and received awards totaling 2,525 credits (1,000 credits for the play shown in FIG. 3B, 500 credits for the play shown in FIG. 3C, 25 credits for the play shown in FIG. 3E, and 1,000 credits for the play shown in FIG. 3F). Accordingly, in this example the player's amount of net winnings is 2,500 credits (2,525 credits of awards minus 25 credits of wagers). Thus, in this embodiment, since the amount of net winnings achieved by the player in the monitored plays of the wagering game is 2,500 credits, the gaming system would determine that the player had a positive winning gaming session if the designated amount of net winnings is less than or equal to 2,500 credits.

Figure 4:
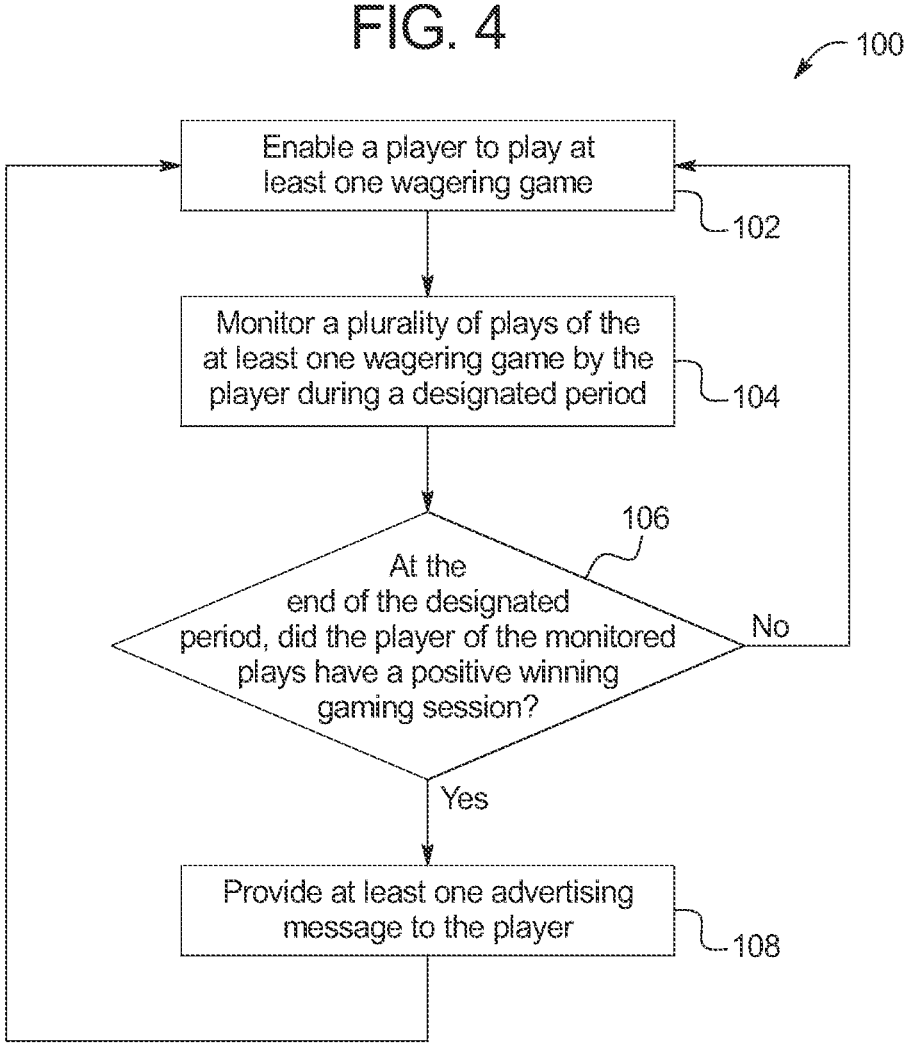
FIG. 4 is a flow chart of a process for operating a gaming system or gaming device of one embodiment of the present disclosure providing advertising messages to players based on a determination of a positive winning gaming session.

FIG. 4 illustrates a flowchart of one example embodiment of a process or method 100 for operating a gaming system or a gaming device. In one embodiment, this process 100 is embodied in one or more software programs stored in one or more memories and executed by one or more processors or controllers. Although this process 100 is described with reference to the flowchart shown in FIG. 4, it should be appreciated that many other processes of performing the acts associated with this illustrated process may be employed. For example, the order of certain of the illustrated blocks and/or diamonds may be changed, certain of the illustrated blocks and/or diamonds may be optional, and/or certain of the illustrated blocks and/or diamonds may not be employed.

In operation of one embodiment, the gaming system enables a player to play at least one wagering game, as indicated by block 102. The gaming system monitors a plurality of plays of the at least one wagering game played by the player during a designated period, as indicated by block 104. At the end of the designated period, the gaming system determines whether the player of the monitored plays had a positive winning gaming session, as indicated by diamond 106. If, at the end of the designated period, the player of the monitored plays had a positive winning gaming session, the gaming system provides at least one advertising message to the player, as indicated by block 108, and returns to block 102. If not, the gaming system returns to block 102.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one display device;

at least one input device;

at least one processor; and at least one memory device storing a plurality of instructions which, when executed by the at least one processor, cause the at least one processor to operate with the at least one display device and the at least one input device to:

(a) monitor a plurality of plays of at least one wagering game that occur during a designated period, each of the monitored plurality of plays resulting in one or more of a plurality of different outcomes;

(b) upon conclusion of the designated period, determine whether a player of the monitored plurality of plays had a positive winning gaming session based, at least in part, on the cumulative outcomes of the monitored plurality of plays; and (c) if the player had a positive winning gaming session, provide at least one advertising message.

2. The gaming system of claim 1, wherein the designated period concludes upon an occurrence of a designated triggering event.

3. The gaming system of claim 2, wherein the designated triggering event occurs upon receipt of a cash out input from the player.

4. The gaming system of claim 1, wherein the designated period is a period of time.

5. The gaming system of claim 1, wherein the designated period is a quantity of two or more plays of the at least one wagering game.

6. The gaming system of claim 1, wherein the plurality of outcomes includes at least one winning outcome, and the plurality of instructions, when executed by the at least one processor, cause the at least one processor to determine that the player had a positive winning gaming session if a quantity of the monitored plurality of plays in which the player achieved the at least one winning outcome is greater than or equal to a designated quantity of monitored plays.

7. The gaming system of claim 1, wherein the plurality of outcomes includes at least one winning outcome, and the plurality of instructions, when executed by the at least one processor, cause the at least one processor to determine that the player had a positive winning gaming session if a quantity of the at least one winning outcome achieved by the player in the monitored plurality of plays is greater than or equal to a designated quantity of winning outcomes.

8. The gaming system of claim 1, wherein the plurality of outcomes includes at least one winning outcome and at least one losing outcome, and the plurality of instructions, when executed by the at least one processor, cause the at least one processor to determine that the player had a positive winning gaming session if a frequency of the at least one winning outcome is greater than or equal to a designated frequency of winning outcomes.

9. The gaming system of claim 8, wherein the frequency of the at least one winning outcome is equal to a quantity of the monitored plurality of plays in which the player achieved the at least one winning outcome divided by a total quantity of the monitored plurality of plays.

10. The gaming system of claim 8, wherein the frequency of the at least one winning outcome is equal to a quantity of the at least one winning outcome achieved in the monitored plurality of plays divided by a sum of the quantity of the at least one winning outcome achieved in the monitored plurality of plays and a quantity of the at least one losing outcome achieved in the monitored plurality of plays.

11. The gaming system of claim 8, wherein the frequency of the at least one winning outcome is equal to a quantity of the at least one winning outcome achieved in the monitored plurality of plays divided by a total quantity of the monitored plurality of plays.

12. The gaming system of claim 1, wherein the plurality of outcomes includes at least one winning outcome, each of the at least one winning outcome is associated with an award, and the plurality of instructions, when executed by the at least one processor, cause the at least one processor to determine that the player had a positive winning gaming session if an amount of net winnings is greater than or equal to a designated amount of net winnings, the amount of net winnings including any awards won by the player in the monitored plurality of plays minus any wagers placed by the player in the monitored plurality of plays.

13. The gaming system of claim 1, wherein the at least one advertising message is at least one selected from the group consisting of: a game trailer, a promotional teaser, a product advertisement or promotion, a gaming system operator advertisement or promotion, a third party advertisement or promotion, an advertisement or promotion for a wagering game nearing a progressive payout, an advertisement or promotion for merchandise, an advertisement or promotion for a movie, a movie trailer, an advertisement or promotion for a casino event, and an advertisement or promotion for a wagering game.

14. A method of operating a gaming system, said method comprising:

(a) causing at least one processor to execute a plurality of instructions stored in at least one memory device to monitor a plurality of plays of at least one wagering game that occur during a designated period, each of the monitored plurality of plays resulting in one or more of a plurality of different outcomes;

(b) causing the at least one processor to execute the plurality of instructions to, upon conclusion of the designated period, determine whether a player of the monitored plurality of plays had a positive winning gaming session based, at least in part, on the cumulative outcomes of the monitored plurality of plays; and (c) if the player had a positive winning gaming session, causing the at least one processor to execute the plurality of instructions to provide at least one advertising message.

15. The method of claim 14, wherein the designated period concludes upon an occurrence of a designated triggering event.

16. The method of claim 15, wherein the designated triggering event occurs upon receipt of a cash out input from the player.

17. The method of claim 14, wherein the designated period is a period of time.

18. The method of claim 14, wherein the designated period is a quantity of two or more plays of the at least one wagering game.

19. The method of claim 14, wherein the plurality of outcomes includes at least one winning outcome, and which includes causing the at least one processor to execute the plurality of instructions to determine that the player had a positive winning gaming session if a quantity of the monitored plurality of plays in which the player achieved the at least one winning outcome is greater than or equal to a designated quantity of monitored plays.

20. The method of claim 14, wherein the plurality of outcomes includes at least one winning outcome, and which includes causing the at least one processor to execute the plurality of instructions to determine that the player had a positive winning gaming session if a quantity of the at least one winning outcome achieved by the player in the monitored plurality of plays is greater than or equal to a designated quantity of winning outcomes.

21. The method of claim 14, wherein the plurality of outcomes includes at least one winning outcome and at least one losing outcome, and which includes causing the at least one processor to execute the plurality of instructions to determine that the player had a positive winning gaming session if a frequency of the at least one winning outcome is greater than or equal to a designated frequency of winning outcomes.

22. The method of claim 21, wherein the frequency of the at least one winning outcome is equal to a quantity of the monitored plurality of plays in which the player achieved the at least one winning outcome divided by a total quantity of the monitored plurality of plays.

23. The method of claim 21, wherein the frequency of the at least one winning outcome is equal to a quantity of the at least one winning outcome achieved in the monitored plurality of plays divided by a sum of the quantity of the at least one winning outcome achieved in the monitored plurality of plays and a quantity of the at least one losing outcome achieved in the monitored plurality of plays.

24. The method of claim 21, wherein the frequency of the at least one winning outcome is equal to a quantity of the at least one winning outcome achieved in the monitored plurality of plays divided by a total quantity of the monitored plurality of plays.

25. The method of claim 14, wherein the plurality of outcomes includes at least one winning outcome, each of the at least one winning outcome being associated with an award, and which includes causing the at least one processor to execute the plurality of instructions to determine that the player had a positive winning gaming session if an amount of net winnings is greater than or equal to a designated amount of net winnings, the amount of net winnings including any awards won by the player in the monitored plurality of plays minus any wagers placed by the player in the monitored plurality of plays.

26. The method of claim 14, wherein the at least one advertising message is at least one selected from the group consisting of: a game trailer, a promotional teaser, a product advertisement or promotion, a gaming system operator advertisement or promotion, a third party advertisement or promotion, an advertisement or promotion for a wagering game nearing a progressive payout, an advertisement or promotion for merchandise, an advertisement or promotion for a movie, a movie trailer, an advertisement or promotion for a casino event, and an advertisement or promotion for a wagering game.

27. The method of claim 14, which is provided through a data network.

28. The method of claim 27, wherein the data network is an internet.

29. A non-transitory computer readable medium including a plurality of instructions which, when executed by at least one processor, cause the at least one processor to:

(a) monitor a plurality of plays of at least one wagering game that occur during a designated period, each of the monitored plurality of plays resulting in one or more of a plurality of different outcomes;

(b) upon conclusion of the designated period, determine whether a player of the monitored plurality of plays had a positive winning gaming session based, at least in part, on the cumulative outcomes of the monitored plurality of plays; and (c) if the player had a positive winning gaming session, provide at least one advertising message.

30. The non-transitory computer readable medium of claim 29, wherein the designated period concludes upon an occurrence of a designated triggering event.

31. The non-transitory computer readable medium of claim 30, wherein the designated triggering event occurs upon receipt of a cash out input from the player.

32. The non-transitory computer readable medium of claim 29, wherein the designated period is a period of time.

33. The non-transitory computer readable medium of claim 29, wherein the designated period is a quantity of two or more plays of the at least one wagering game.

34. The non-transitory computer readable medium of claim 29, wherein the plurality of outcomes includes at least one winning outcome, and the plurality of instructions, when executed by the at least one processor, cause the at least one processor to determine that the player had a positive winning gaming session if a quantity of the monitored plurality of plays in which the player achieved the at least one winning outcome is greater than or equal to a designated quantity of monitored plays.

35. The non-transitory computer readable medium of claim 29, wherein the plurality of outcomes includes at least one winning outcome, and the plurality of instructions, when executed by the at least one processor, cause the at least one processor to determine that the player had a positive winning gaming session if a quantity of the at least one winning outcome achieved by the player in the monitored plurality of plays is greater than or equal to a designated quantity of winning outcomes.

36. The non-transitory computer readable medium of claim 29, wherein the plurality of outcomes includes at least one winning outcome and at least one losing outcome, and the plurality of instructions, when executed by the at least one processor, cause the at least one processor to determine that the player had a positive winning gaming session if a frequency of the at least one winning outcome is greater than or equal to a designated frequency of winning outcomes.

37. The non-transitory computer readable medium of claim 36, wherein the frequency of the at least one winning outcome is equal to a quantity of the monitored plurality of plays in which the player achieved the at least one winning outcome divided by a total quantity of the monitored plurality of plays.

38. The non-transitory computer readable medium of claim 36, wherein the frequency of the at least one winning outcome is equal to a quantity of the at least one winning outcome achieved in the monitored plurality of plays divided by a sum of the quantity of the at least one winning outcome achieved in the monitored plurality of plays and a quantity of the at least one losing outcome achieved in the monitored plurality of plays.

39. The non-transitory computer readable medium of claim 36, wherein the frequency of the at least one winning outcome is equal to a quantity of the at least one winning outcome achieved in the monitored plurality of plays divided by a total quantity of the monitored plurality of plays.

40. The non-transitory computer readable medium of claim 29, wherein the plurality of outcomes includes at least one winning outcome, each of the at least one winning outcome is associated with an award, and the plurality of instructions, when executed by the at least one processor, cause the at least one processor to determine that the player had a positive winning gaming session if an amount of net winnings is greater than or equal to a designated amount of net winnings, the amount of net winnings including any awards won by the player in the monitored plurality of plays minus any wagers placed by the player in the monitored plurality of plays.

41. The non-transitory computer readable medium of claim 29, wherein the at least one advertising message is at least one selected from the group consisting of: a game trailer, a promotional teaser, a product advertisement or promotion, a gaming system operator advertisement or promotion, a third party advertisement or promotion, an advertisement or promotion for a wagering game nearing a progressive payout, an advertisement or promotion for merchandise, an advertisement or promotion for a movie, a movie trailer, an advertisement or promotion for a casino event, and an advertisement or promotion for a wagering game.

* * * * *